US011618023B2

(12) United States Patent
Kvist et al.

(10) Patent No.: US 11,618,023 B2
(45) Date of Patent: Apr. 4, 2023

(54) MICROFLUIDIC DEVICE AND A METHOD FOR PROVISION OF EMULSION DROPLETS

(71) Applicant: SAMPLIX APS, Herlev (DK)

(72) Inventors: Thomas Kvist, Roskilde (DK); Solène Cherre, Virum (DK); Marie Just Mikkelsen, Brønshøj (DK)

(73) Assignee: SAMPLIX APS, Herlev (DK)

( * ) Notice: Subject to any disclaimer, the term of this patent is extended or adjusted under 35 U.S.C. 154(b) by 395 days.

(21) Appl. No.: 16/770,138

(22) PCT Filed: Dec. 4, 2018

(86) PCT No.: PCT/EP2018/083494
§ 371 (c)(1),
(2) Date: Jun. 5, 2020

(87) PCT Pub. No.: WO2019/110591
PCT Pub. Date: Jun. 13, 2019

(65) Prior Publication Data

US 2020/0384469 A1 Dec. 10, 2020

(30) Foreign Application Priority Data

Dec. 6, 2017 (EP) ..... 17205775

(51) Int. Cl.
*B01L 3/00* (2006.01)
*B01F 23/41* (2022.01)
*B01F 33/3011* (2022.01)

(52) U.S. Cl.
CPC ..... *B01L 3/502784* (2013.01); *B01F 23/41* (2022.01); *B01F 23/4144* (2022.01);
(Continued)

(58) Field of Classification Search
CPC ..... B01F 2215/0422; B01F 2215/0431; B01F 23/41; B01F 23/4143; B01F 23/4144;
(Continued)

(56) References Cited

U.S. PATENT DOCUMENTS 7,772,287 B2 8/2010 Higuchi et al.
8,802,027 B2 8/2014 Abate et al.
(Continued)

FOREIGN PATENT DOCUMENTS

EP 2635840 B1 1/2017
WO WO 2015/160919 A1 10/2015

OTHER PUBLICATIONS

De Menech et al "Transition from squeezing to dripping in a microfluidic T-shaped junction" J. Fluid Mech. vol. 595, pp. 141-161. Cambridge University Press doi:10.1017/S002211200700910X (Year: 2008).*
(Continued)

*Primary Examiner* — Jennifer Wecker
*Assistant Examiner* — Jonathan Bortoli
(74) *Attorney, Agent, or Firm* — Casimir Jones SC; Lisa Mueller

(57) ABSTRACT

The present invention relates to a microfluidic device and method for providing emulsion droplets. The device comprising: a microfluidic section comprising one or more microfluidic units; and a well section comprising one or more groups of wells comprising one group of wells for each microfluidic unit; the well section and the microfluidic section forming a fixedly connected unit such that each group of wells forms a fixedly connected unit with a respective corresponding microfluidic unit, each microfluidic unit comprising a fluid conduit network comprising: a plurality of supply conduits comprising a secondary supply conduit and a primary supply conduit comprising a capillary
(Continued)

structure having a volume of at least 2 μL; a transfer conduit; and a first fluid junction providing fluid communication between the primary supply conduit, the secondary supply conduit, and the transfer conduit; each group of wells comprising a plurality of wells comprising a collection well and one or more supply wells comprising a primary supply well, the collection well being in fluid communication with the transfer conduit of the corresponding microfluidic unit, the primary supply well being in fluid communication with the primary supply conduit and the secondary supply conduit of the corresponding microfluidic unit.

12 Claims, 15 Drawing Sheets

(52) U.S. Cl.
CPC ..... *B01F 33/3011* (2022.01); *B01F 23/4143* (2022.01); *B01F 23/4145* (2022.01); *B01F 2215/0422* (2013.01); *B01F 2215/0431* (2013.01); *B01L 2200/027* (2013.01); *B01L 2300/0864* (2013.01); *B01L 2300/12* (2013.01); *B01L 2400/0406* (2013.01)

(58) Field of Classification Search
CPC ..... B01F 23/4145; B01F 33/3011; B01L 2200/027; B01L 2200/0673; B01L 2300/0816; B01L 2300/0864; B01L 2300/0867; B01L 2300/0877; B01L 2300/0883; B01L 2300/12; B01L 2400/0406; B01L 3/502715; B01L 3/502784; B01L 2300/0874
See application file for complete search history.

(56) References Cited

U.S. PATENT DOCUMENTS

| | | | | |
|---|---|---|---|---|
| 9,039,273 | B2 | 5/2015 | Weitz et al. | |
| 9,238,206 | B2 | 1/2016 | Rotem et al. | |
| 2003/0099577 | A1* | 5/2003 | Renaud | B01L 3/0265 422/521 |
| 2012/0190032 | A1* | 7/2012 | Ness | G01N 35/085 435/6.12 |
| 2012/0211084 | A1 | 8/2012 | Weitz et al. | |
| 2012/0256354 | A1* | 10/2012 | DeSimone | B29C 66/91431 264/225 |
| 2014/0378348 | A1* | 12/2014 | Makarewicz, Jr. | C12Q 1/6806 506/40 |
| 2017/0022538 | A1 | 1/2017 | Abate et al. | |
| 2017/0065979 | A1 | 3/2017 | Ness et al. | |
| 2017/0304785 | A1 | 10/2017 | Link et al. | |

OTHER PUBLICATIONS

Becker et al., Polymer microfabrication technologies for microfluidic systems. Anal Bioanal Chem. Jan. 2008;390(1):89-111.
Berthier et al., Engineers are from PDMS-land, Biologists are from Polystyrenia. Lab Chip. Apr. 7, 2012;12(7):1224-37.
Larsen et al., One-step polymer surface modification for minimizing drug, protein, and DNA adsorption in microanalytical systems. Lab Chip. Feb. 21, 2013;13(4):669-75.
Ozcam et al., Effect of ultraviolet/ozone treatment on the surface and bulk properties of poly(dimethyl siloxane) and poly(vinylmethyl siloxane) networks. Polymer, 2014, vol. 55, Issue 14, p. 3107-3119.
Subedi et al., Effect of UV-treatment on the wettability of polycarbonate. Kathmandu University Journal of science, engineering and technology, vol. 5, No. II, 2009, pp. 37-41.
Tan et al., Oxygen plasma treatment for reducing hydrophobicity of a sealed polydimethylsiloxane microchannel. Biomicrofluidics. Sep. 30, 2010;4(3):32204.
Yuan et al., Contact Angle and Wetting Properties. In: Bracco G., Holst B. (eds) Surface Science Techniques. Springer Series in Surface Sciences, vol. 51. 2013, p. 3-34.
Elve Flow, PDMS in biology research: A critical review on PDMS lithography for biological studies, Dec. 29, 2017, http://www.elveflow.com/microfluidic-tutorials/cell-biology-imaging-reviews-and-tutorials/microfluidic-for-cell-biology/pdms-in-biology-researches-a-critical-review-on-pdms-lithography-for-biological-studies/.
Plasma-Therm, Plasma Enhanced Chemical Vapor Deposition (PECVD), Nov. 5, 2018, http://www.plasma-therm.com/pecvd.html.
MEMSnet, MEMS Thin Film Deposition Processes, Nov. 4, 2018, https://www.memsnet.org/mems/processes/deposition.html.
Geleste, Inc. Hydrophobicity, Hydrophilicity, and Silane Surface Modification, By Barry Arkles, 2011 https://www.pcimag.com/ext/resources/PCI/Home/Files/PDFs/Virtual_Supplier_Brochures/Gelest_Additives.pdf.
Vetaphone, Corona Treatment, Nov. 22, 2018, www.vetaphone.com/technology/corona-treatment.

* cited by examiner

MICROFLUIDIC DEVICE AND A METHOD FOR PROVISION OF EMULSION DROPLETS

CROSS-REFERENCE TO RELATED APPLICATIONS

This application is a national phase application under 35 U.S.C. § 371 of PCT International Application No. PCT/EP2018/083494, filed Dec. 4, 2018, which claims the benefit of European Application No. 17205775.4, filed Dec. 6, 2017, each of which is herein incorporated by reference.

The present invention relates to a microfluidic device, a method for manufacturing a microfluidic device, and a method for provision of emulsion droplets using a microfluidic device. Furthermore, the present invention relates to a kit comprising a plurality of microfluidic devices and a plurality of fluids configured for use with the microfluidic device for provision of emulsion droplets.

Emulsion droplets, such as comprising an aqueous inner phase and an oil outer carrier phase, have found use in many industrial, medical, and research applications. Such applications may for instance comprise: drug delivery, delivery vehicles for cosmetics, cell encapsulation, and synthetic biology. Partitioning of cells, chemicals, or molecules into millions of smaller partitions, as may be provided using emulsion droplets, may separate the reactions of each unit, which may enable processing or analysis of each partition separately.

Prior art microfluidic devices and methods for provision of double emulsion droplets are known from publications such as: EP 11838713; U.S. Pat. No. 9,238,206 B2; US 20170022538 A1; U.S. Pat. No. 8,802,027 B2; US 20120211084; U.S. Pat. No. 9,039,273 B2; and U.S. Pat. No. 7,772,287 B2.

The inventors of the present invention have identified potential drawbacks of the prior art devices and methods. Identified potential drawbacks may include complex and/or time-consuming operation for provision of emulsion droplets. Identified potential drawbacks of the prior art may include risk of contamination of samples when prior art microfluidic chips are connected to fluid reservoirs via tubing and other connectors and/or when microfluidic chips of different surface properties are connected to each other in series using tubing. Identified potential drawbacks of the prior art may include loss of samples in tubing provided between different components of prior art systems. Identified potential drawbacks of the prior art may include provision of unstable air pressure due to the use of complex tubing systems for connecting components of the prior art systems. Some or all of these potential drawbacks of prior art systems may cause polydisperse droplets, which may be undesired.

It may be an object of the present invention to provide improved and/or alternative systems and methods for provision of emulsion droplets, such as monodisperse emulsion droplets.

It may be an object of the present invention to reduce and/or to enable reduced use of reagents and/or loss of sample during provision of emulsion droplets, such as monodisperse emulsion droplets.

It may be an object of the present invention to provide devices and methods that may simplify provision of emulsion droplets, such as monodisperse emulsion droplets, and/or may reduce requirements for personnel having significant skills in microfluidics operations.

It may be an object of the present invention to minimize risk of contamination while producing emulsion droplets.

According to an aspect of the present invention, there is provided a microfluidic device comprising a microfluidic section and a well section.

The microfluidic section comprises one or more microfluidic units.

The well section comprises one or more groups of wells. The one or more groups of wells comprise one group of wells for each microfluidic unit. Accordingly, the number of groups of wells may be the same as the number of microfluidic units.

The well section and the microfluidic section form a fixedly connected unit. Each group of wells forms a fixedly connected unit with a respective corresponding microfluidic unit.

Each microfluidic unit comprises a fluid conduit network. Each fluid conduit network comprises a plurality of supply conduits, a transfer conduit, and a first fluid junction.

The plurality of supply conduits comprises a primary supply conduit and a secondary supply conduit.

The primary supply conduit comprises a capillary structure. The capillary structure has a volume of at least 2 μL.

The first fluid junction provides fluid communication between the primary supply conduit, the secondary supply conduit, and the transfer conduit. Accordingly, the first fluid junction may function as a junction between these three conduits.

Each group of wells comprises a plurality of wells. The plurality of wells comprises a collection well and one or more supply wells. The one or more supply wells comprise a primary supply well.

The collection well is in fluid communication with the transfer conduit of the corresponding microfluidic unit. Accordingly, the transfer conduit may provide fluid communication between the collection well and the first fluid junction.

The primary supply well is in fluid communication with the primary supply conduit of the corresponding microfluidic unit. Accordingly, the primary supply conduit may provide fluid communication between the primary supply well and the first fluid junction.

The primary supply well is in fluid communication with the secondary supply conduit of the corresponding microfluidic unit. Accordingly, the secondary supply conduit may provide fluid communication between the primary supply well and the first fluid junction.

The primary supply conduit may be defined as the part of the fluid conduit network being provided between the primary supply well and the first fluid junction via the capillary structure.

The secondary supply conduit may be defined as the part of the fluid conduit network being provided between the primary supply well and the first fluid junction, bypassing the capillary structure.

According to an aspect of the present invention, there is provided a kit comprising one or more of the microfluidic device according to the present invention and a plurality of fluids configured for use with the microfluidic device according to the present invention. The plurality of fluids configured for use with the microfluidic device according to the present invention comprises a first fluid and a second fluid. The first fluid may comprise a sample buffer. The second fluid may comprise an oil. The kit may comprise an enzyme and nucleotides.

According to an aspect of the present invention, there is provided a method for providing emulsion droplets. For the provision of emulsion droplets, the method comprises use of any of: the microfluidic device according to the present invention; or the kit according to the present invention.

According to an aspect of the present invention, there is provided a method for manufacturing a microfluidic device according to the present invention. The method comprises forming the fixedly connected unit of the well section and the microfluidic section by fixing together a first structure and a second structure, such that fluid communication is provided between the individual wells of each group of wells via the corresponding respective microfluidic unit. The first structure, such as a base well structure piece, comprises at least a part of the well section. The second structure, such as a base microfluidic piece, comprises at least a part of the microfluidic section.

An advantage with the present invention may be facilitation of a simpler manufacturing process and/or facilitation of usage of less material, e.g. compared to a microfluidic device having more wells than the microfluidic device according to the present invention.

An advantage with the present invention may be facilitation of improved and/or different separation of different fluids, i.e. e.g. the first fluid and the second fluid, contained by the microfluidic device prior to formation of emulsions, such as single emulsions.

An advantage with the present invention may be that the second fluid, which may be provided to the primary supply well after the first fluid has been provided to the primary supply well, and which first fluid subsequently has been drawn into the capillary structure, may displace the first fluid in the capillary structure during formation of emulsion droplets, whereby a more complete process may be achieved. A complete process may be considered a process where all of the first fluid has been emulsified and, for formation of single emulsions, being dispersed in the second fluid being in a continuous phase. The second fluid may force any remnants of the first fluid through the fluid conduit network during emulsion formation, which may enable that all or a at least a majority of the first fluid may be processed by the device according to the invention and may be provided to the collection well e.g. in form of droplets.

An advantage with the present invention may be facilitation of an environment, such as the capillary structure, which may be better controlled than a supply well, e.g. in terms of temperature and/or by being shielded from contamination and/or reactions caused by ambient air and/or particles in the ambient air. Accordingly, the time that lapses between providing the first fluid to the microfluidic device according to the present invention may be less critical to keep short compared to prior art solutions.

The microfluidic device and/or any method according to the present invention may be structurally and/or functionally configured according to any statement of any desire of the present disclosure.

An advantage of the present invention, such as the provision of the well section and the microfluidic section being fixedly connected to each other, may comprise that the liquids used for provision of double emulsion droplets, i.e. e.g. the first fluid, the second fluid, and the third fluid, as well as the resulting droplets may be contained within the microfluidic device. This may in turn provide ease of use of the device and the method according to the present invention and/or may provide a low risk of contamination of results and/or may facilitate that droplets generated according to the present invention may be improved with respect to being monodisperse and/or reproducible. This may at least in part be caused by the present invention avoiding or minimizing use of complex connections with extended tubing and connecting features of varying length, as may be used by prior art solutions.

An advantage of the present invention, such as the kit comprising a plurality of fluids configured for use with the microfluidic device according to the present invention, may comprise that the properties of the fluids may be provided such that they are configured for the specific microfluidic device comprised in the kit, which may in turn reduce the risk of using fluids that could compromise droplet production or droplet stability.

An advantage of the method for manufacturing according to the present invention, wherein the method comprises fixing the well section and the microfluidic section to each other, such that fluid communication is provided between the individual wells of each group of wells via the corresponding respective microfluidic units, may comprise, that the risk of leakage of liquids is alleviated. An alternative or additional advantage may comprise that any or some variations in results between parallel and/or consecutive sample production may be alleviated.

The microfluidic device and/or any method according to the present invention may be structurally and/or functionally configured according to any statement of any desire of the present disclosure.

The present invention relates to different aspects including the devices and methods described above and in the following. Each aspect may yield one or more of the benefits and advantages described in connection with one or more of the other aspects. Each aspect may have one or more embodiments with all or just some of the features corresponding to the embodiments described in connection with one or more of the other aspects and/or disclosed in the appended claims.

Other systems, methods and features of the present invention will be or become apparent to one having ordinary skill in the art upon examining the following drawings and detailed description. It is intended that all such additional systems, methods, and features be included in this description, be within the scope of the present invention and protected by the accompanying claims.

BRIEF DESCRIPTION OF THE DRAWINGS

The above, as well as additional objects, features and advantages of the present inventive concept, will be better understood through the following illustrative and non-limiting detailed description of preferred embodiments and/or features of the present inventive concept, with reference to the appended drawings, where like reference numerals may be used for like elements. Furthermore, any reference numerals wherein the last two digits are identical, but where any one or two preceding digits are different, may indicate that those features are structurally differently illustrated, but that these features may refer to the same functional features of the present invention, cf. the list of reference numbers.

The accompanying drawings are included to provide a further understanding of the invention, and are incorporated in and constitute a part of this specification. The drawings illustrate embodiments of the invention and, together with the description, serve to explain the principles of the invention. Other and further aspects and features may be evident from reading the following detailed description of the embodiments.

The drawings illustrate the design and utility of embodiments. These drawings are not necessarily drawn to scale. In order to better appreciate how the above-recited and other advantages and objects are obtained, a more particular description of the embodiments will be rendered, which are illustrated in the accompanying drawings. These drawings may only depict typical embodiments and may therefore not be considered limiting of its scope.

Figure 1:
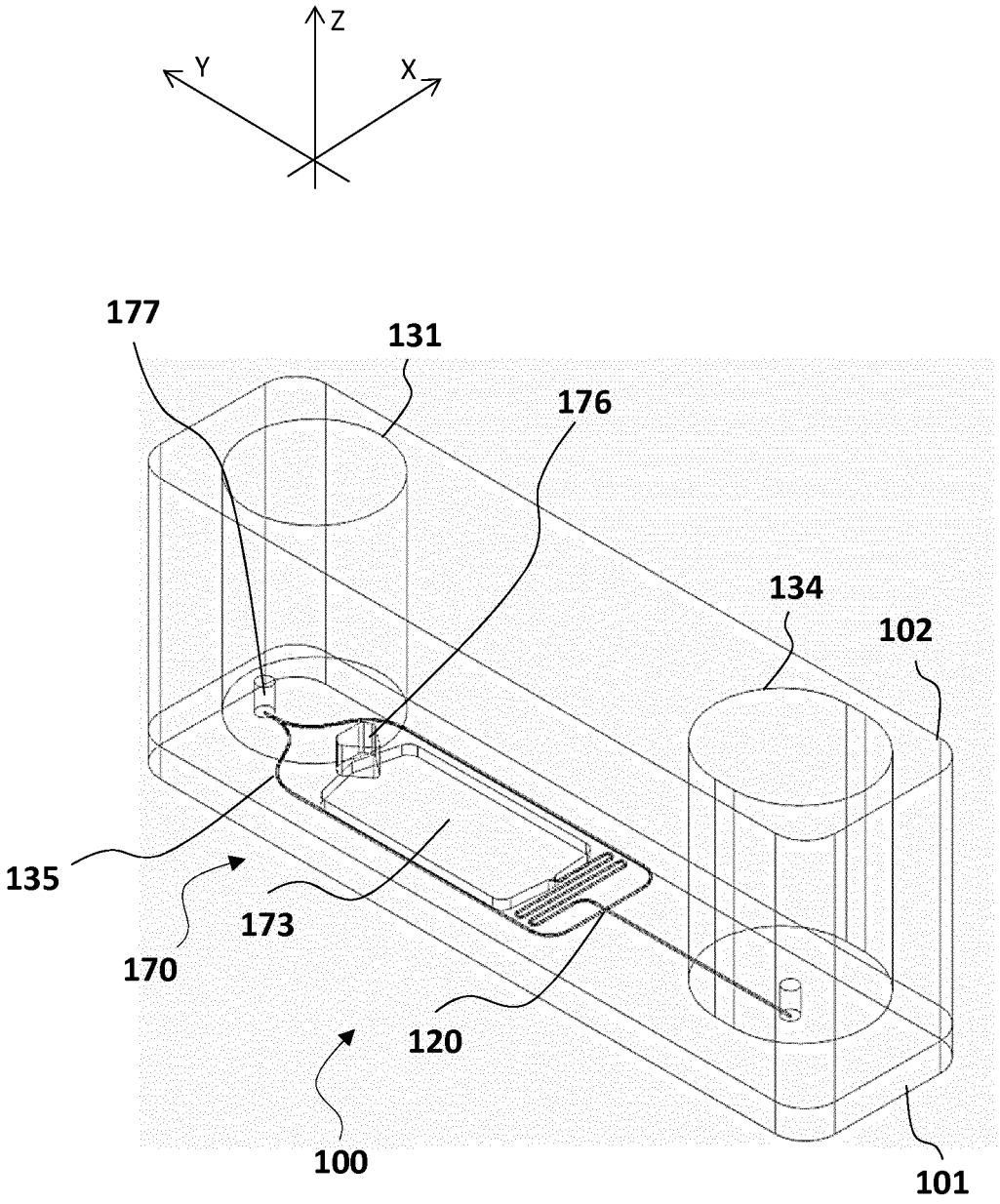

FIG. 1 schematically illustrates an isometric view of a first embodiment of a microfluidic device according to the present invention.

Figure 2:
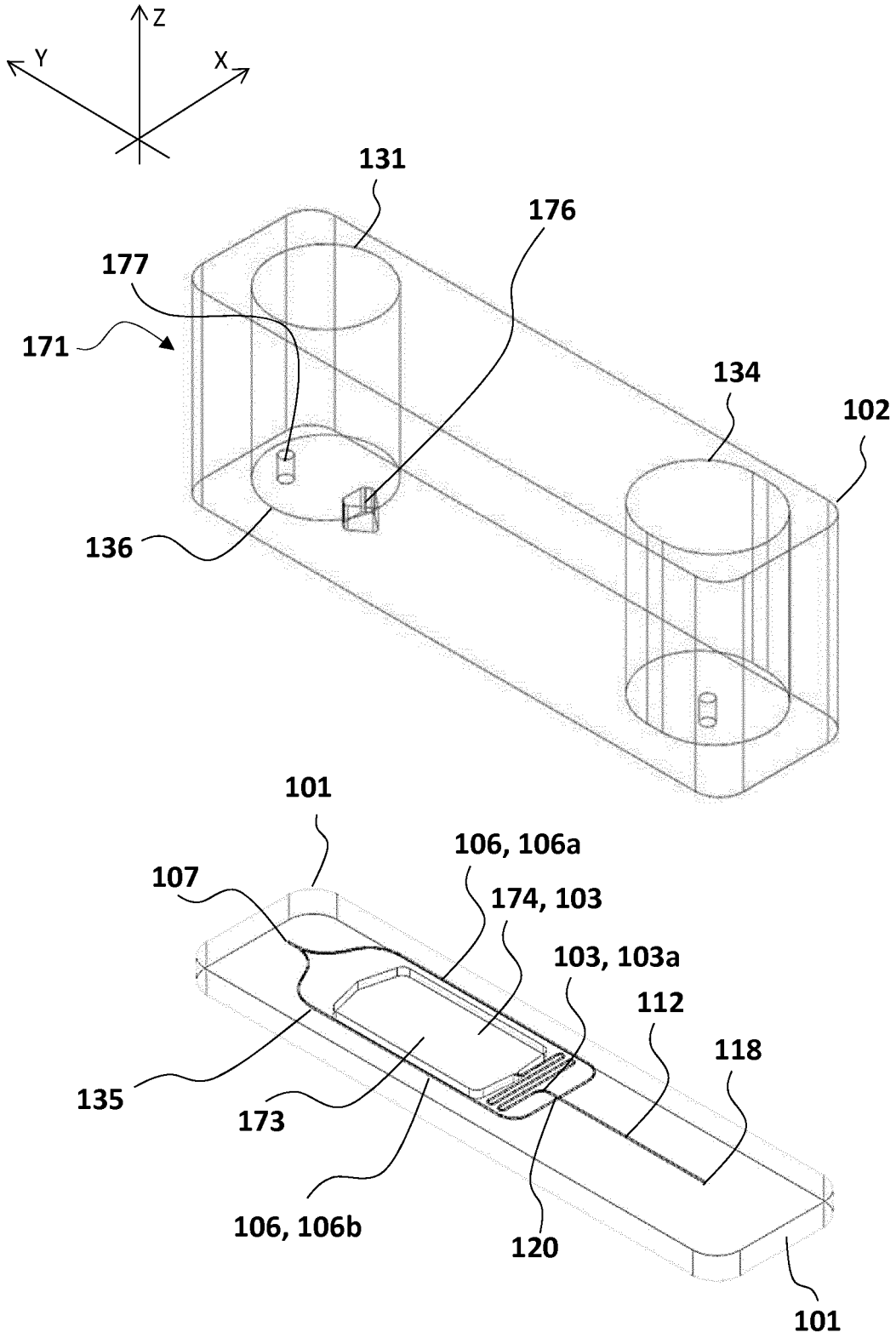

FIG. 2 schematically illustrates an isometric and exploded view of the first embodiment of a microfluidic device.

Figure 3:
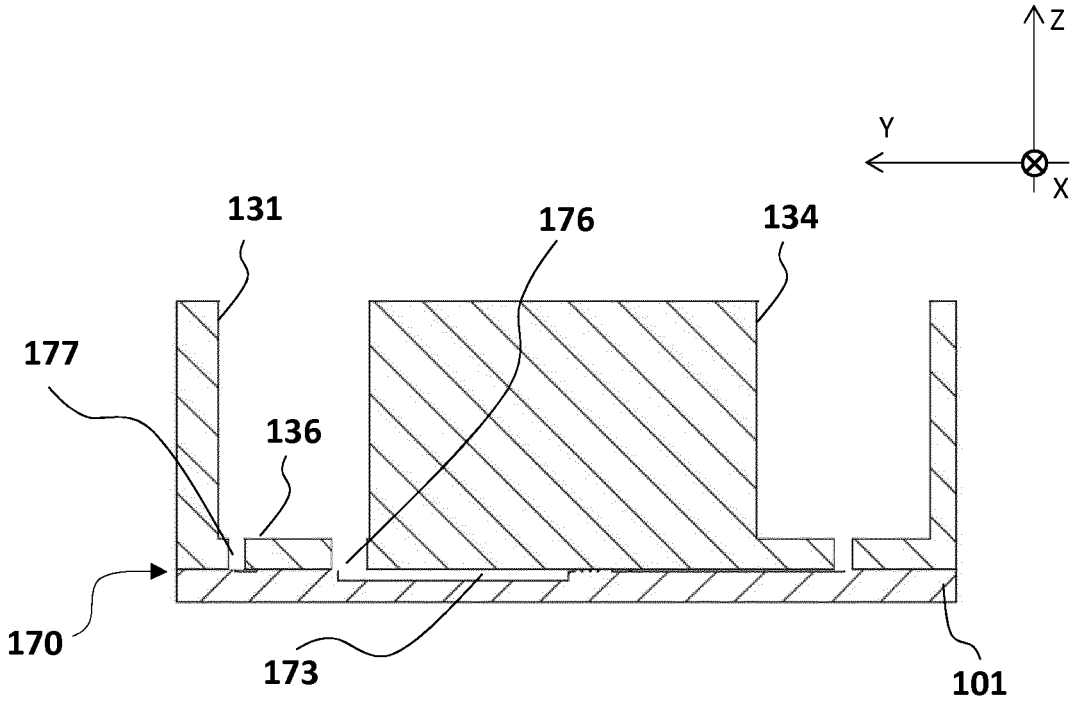

FIG. 3 schematically illustrates a cross-sectional view of the first embodiment as illustrated in FIG. 1.

Figure 4:
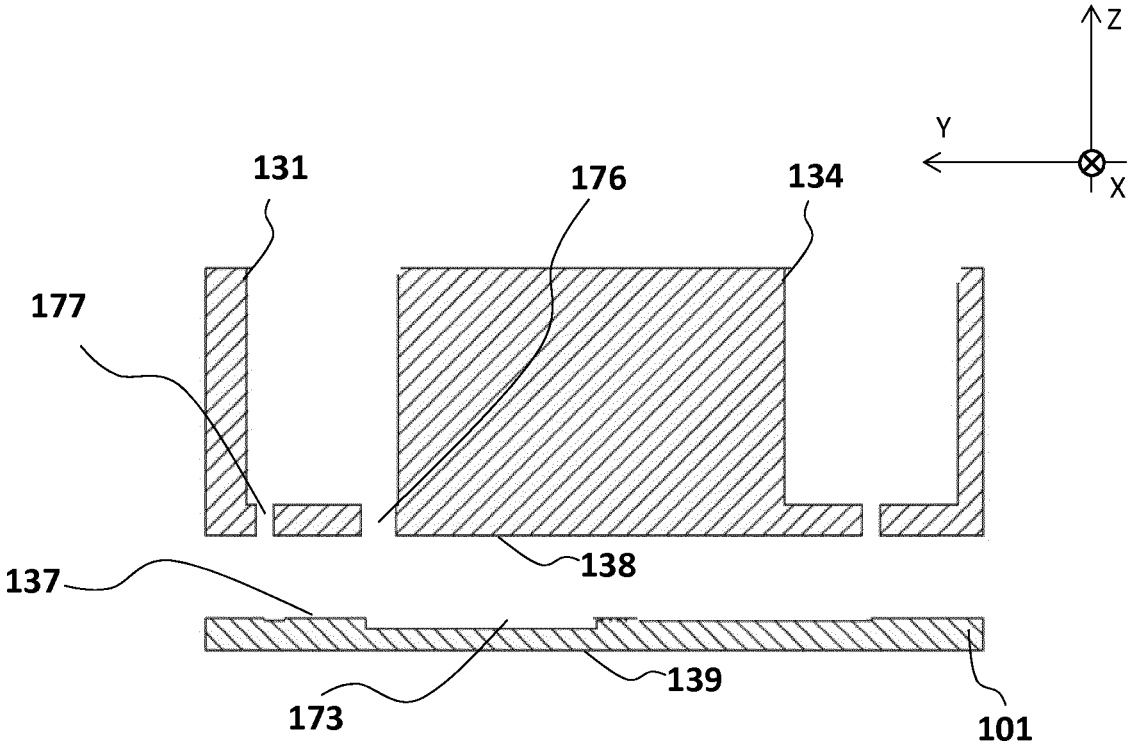

FIG. 4 schematically illustrates a cross-sectional view of the first embodiment as illustrated in FIG. 2.

Figure 5:
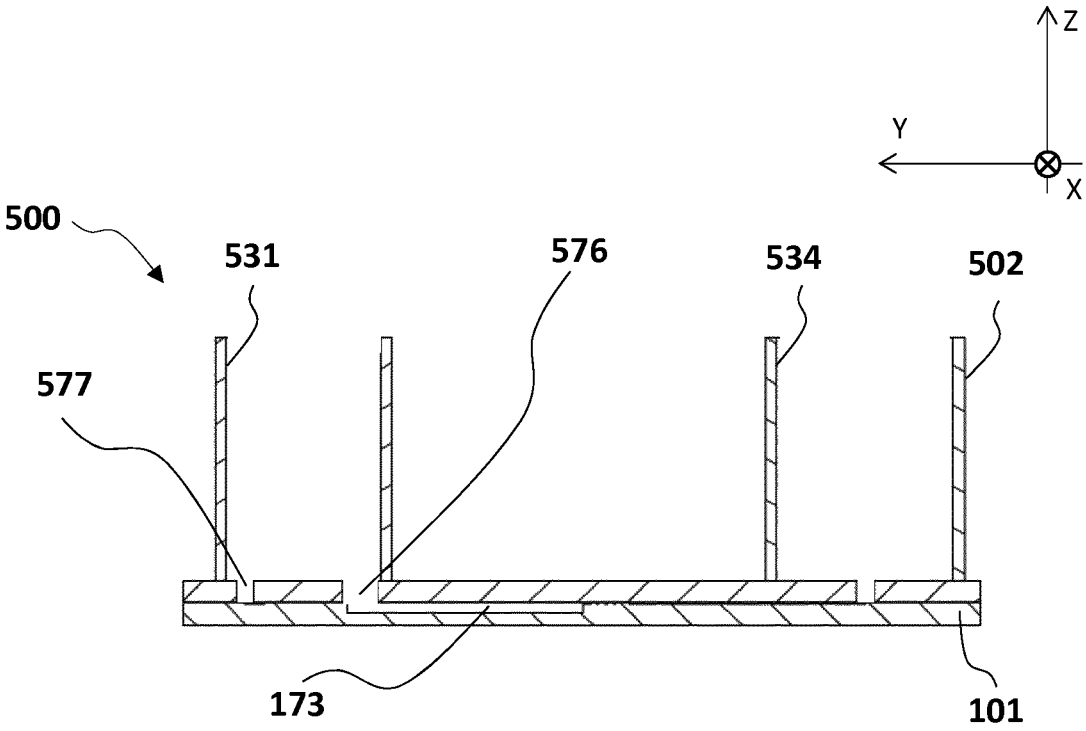

FIG. 5 schematically illustrates a cross-sectional view of a second embodiment of a microfluidic device according to the present invention, the second embodiment being similar to the first embodiment of a microfluidic device.

Figure 6:
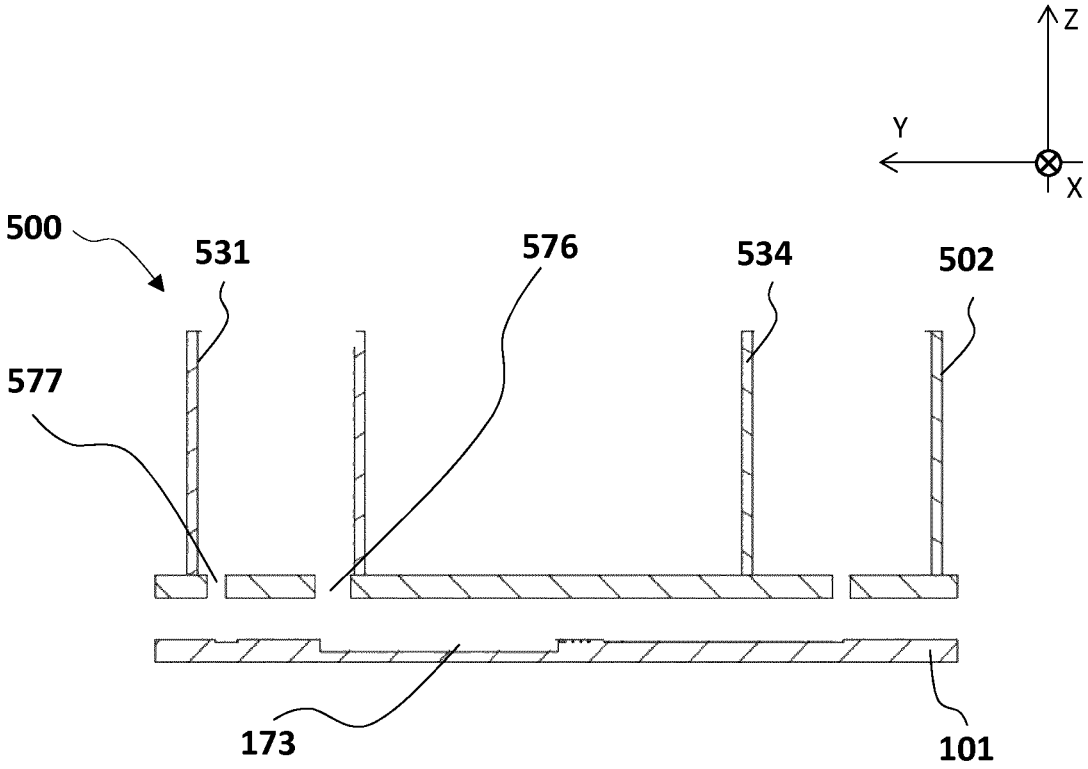

FIG. 6 schematically illustrates a cross-sectional and exploded view of the second embodiment of a microfluidic device.

Figure 7:
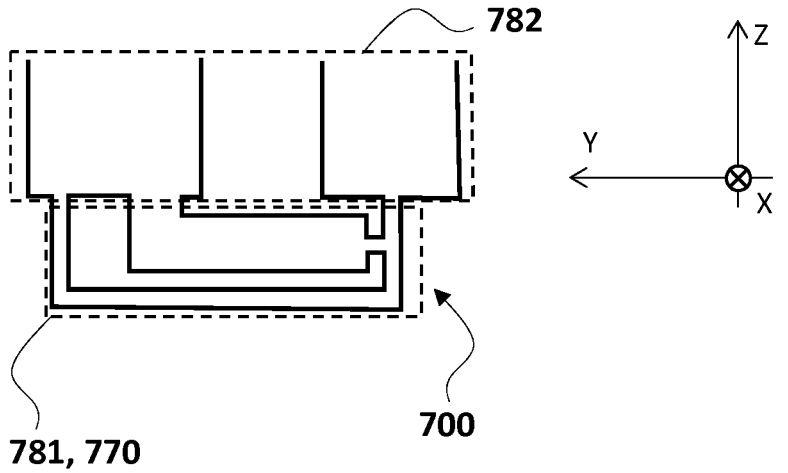
Figure 8:
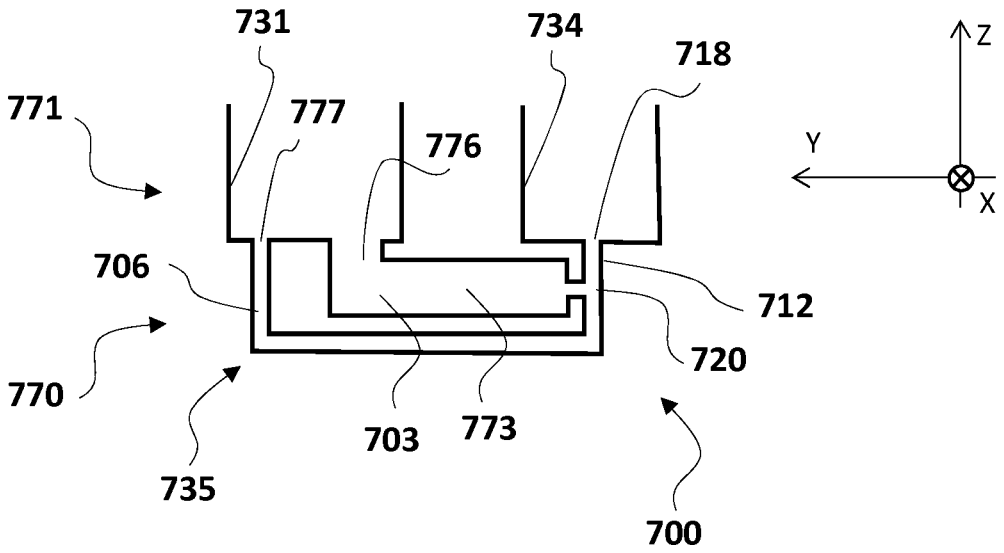

FIGS. 7 and 8 schematically illustrate a third embodiment of a microfluidic device according to the present invention.

Figure 9:
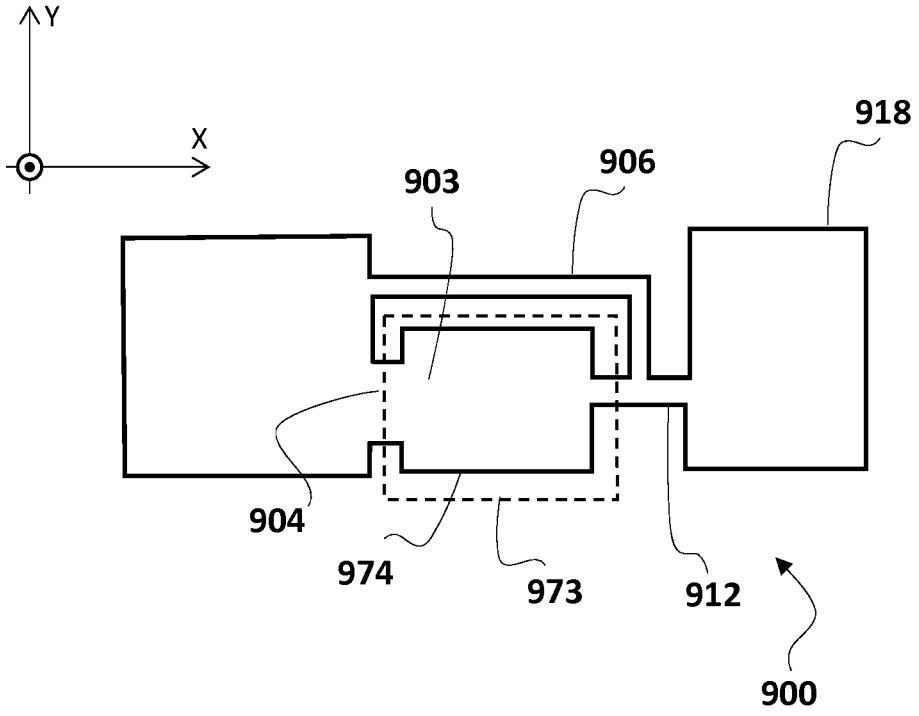
Figure 10:
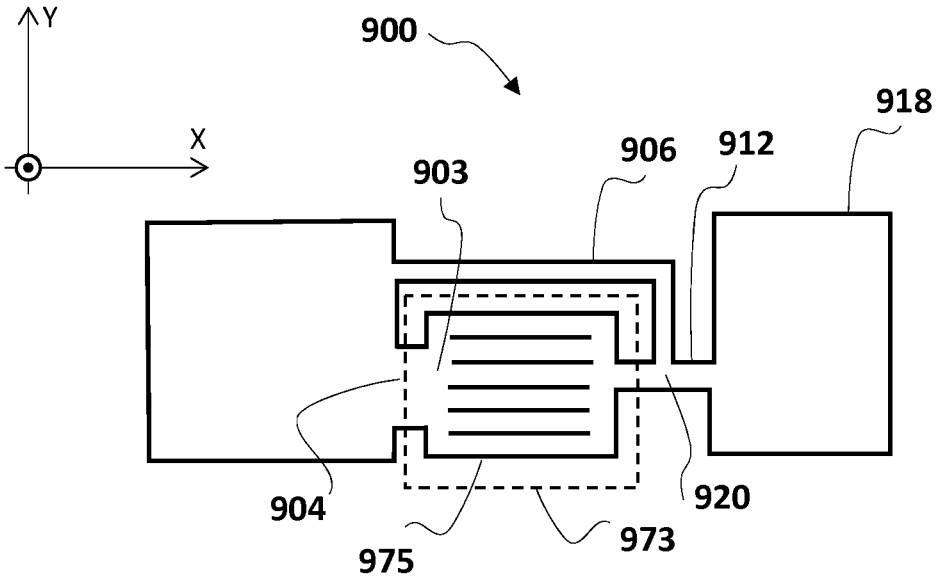

FIGS. 9 and 10 schematically illustrate a fourth embodiment of a microfluidic device according to the present invention.

Figure 11:
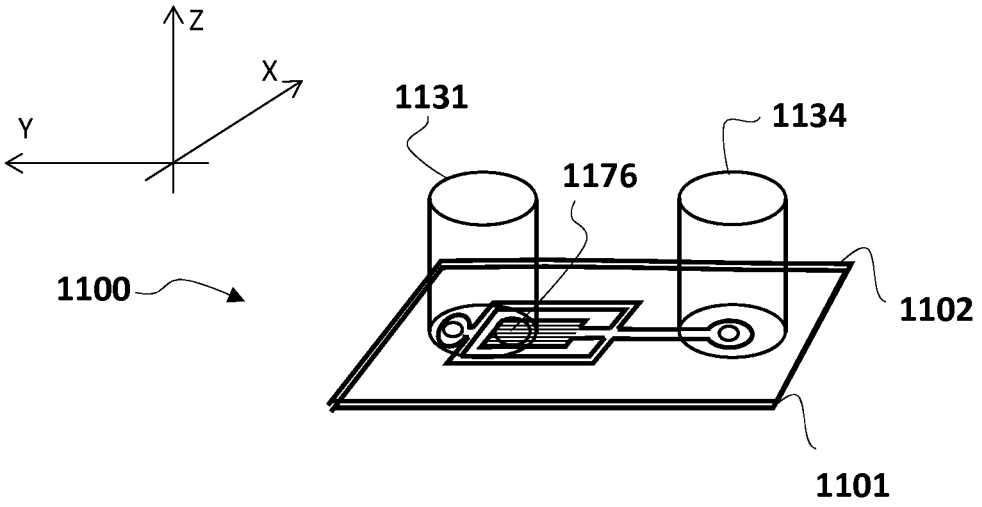

FIG. 11 schematically illustrates a perspective view of a sixth embodiment of a microfluidic device according to the present invention.

Figure 12:
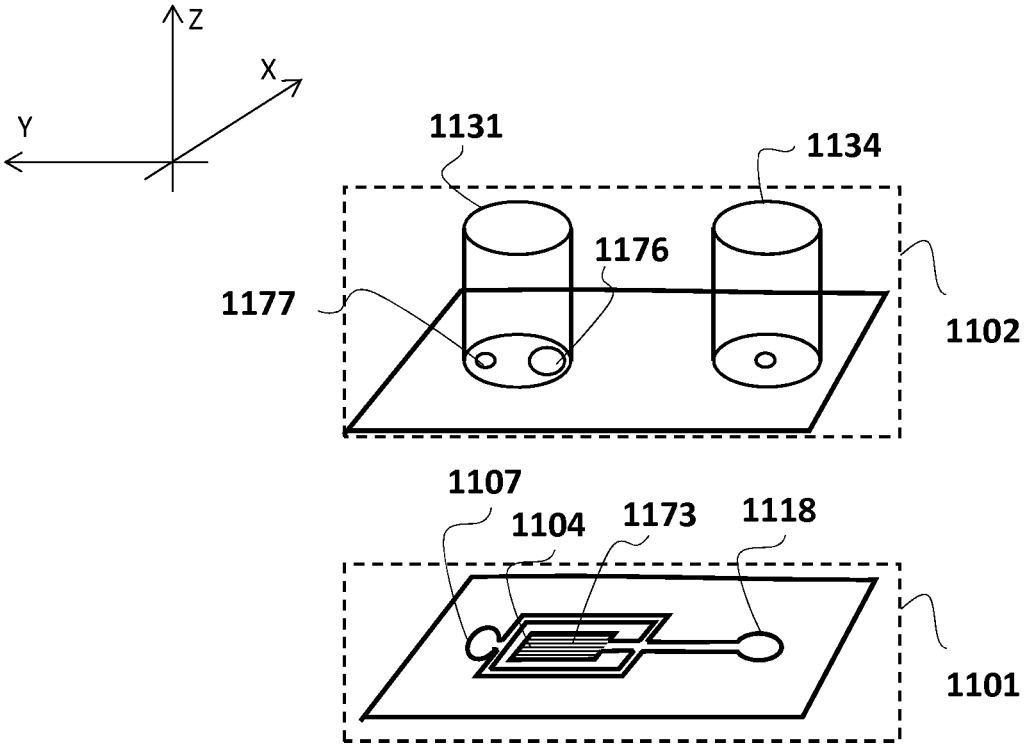

FIG. 12 schematically illustrates a perspective and exploded view of the sixth embodiment of a microfluidic device.

Figure 13:
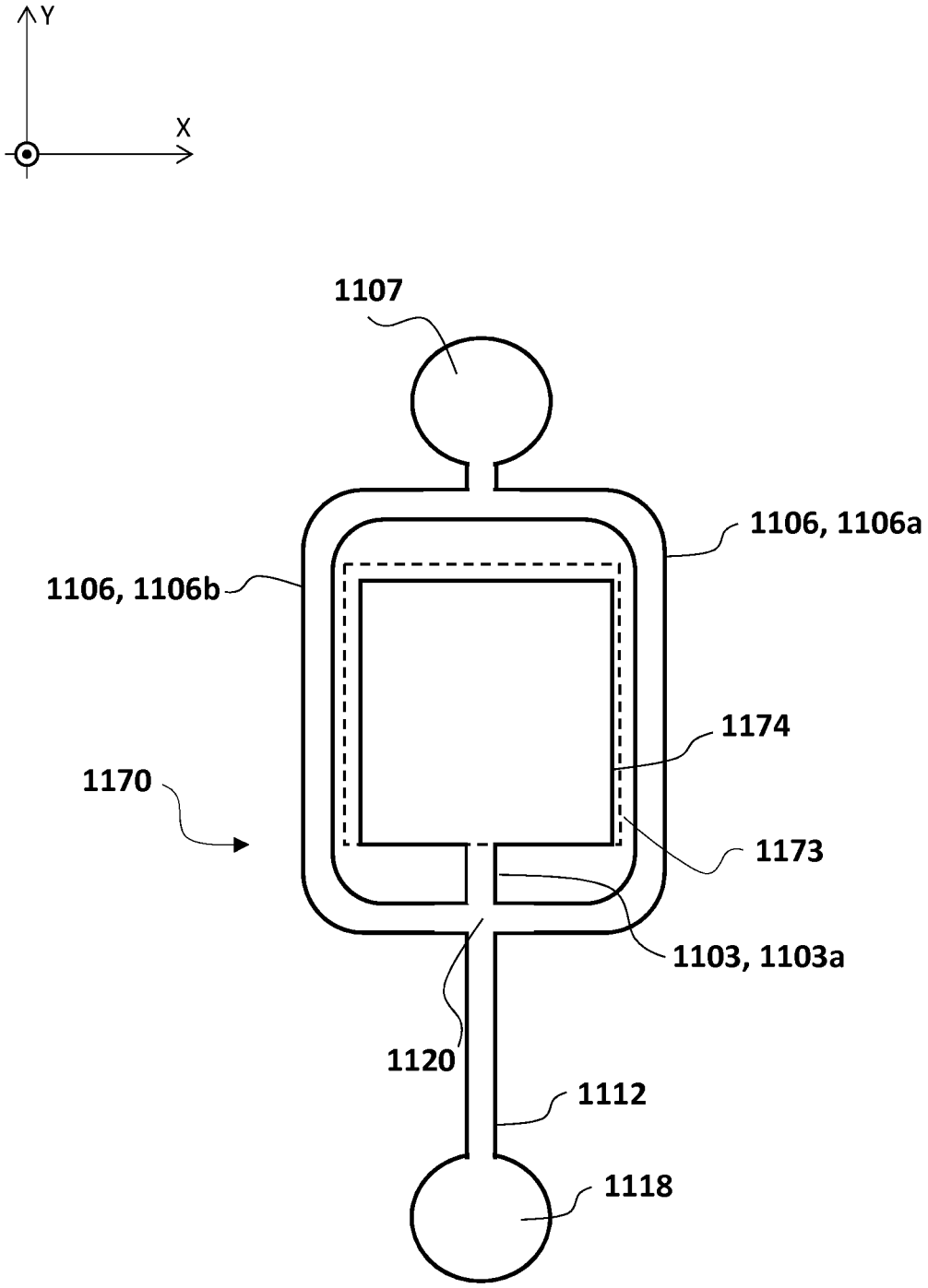

FIG. 13 schematically illustrates a top view of a part of the sixth embodiment of a microfluidic device.

Figure 14:
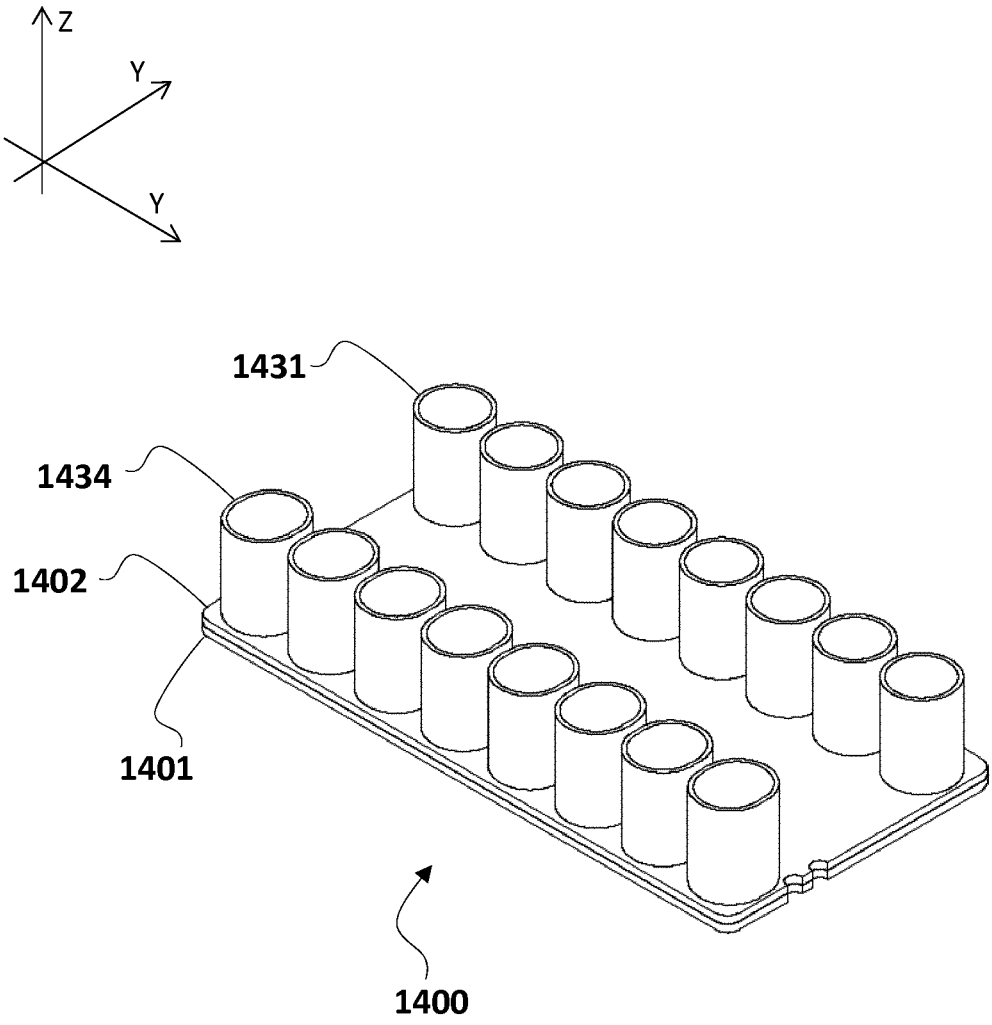

FIG. 14 schematically illustrates an isometric view of a seventh embodiment of a microfluidic device according to the present invention.

Figure 15:
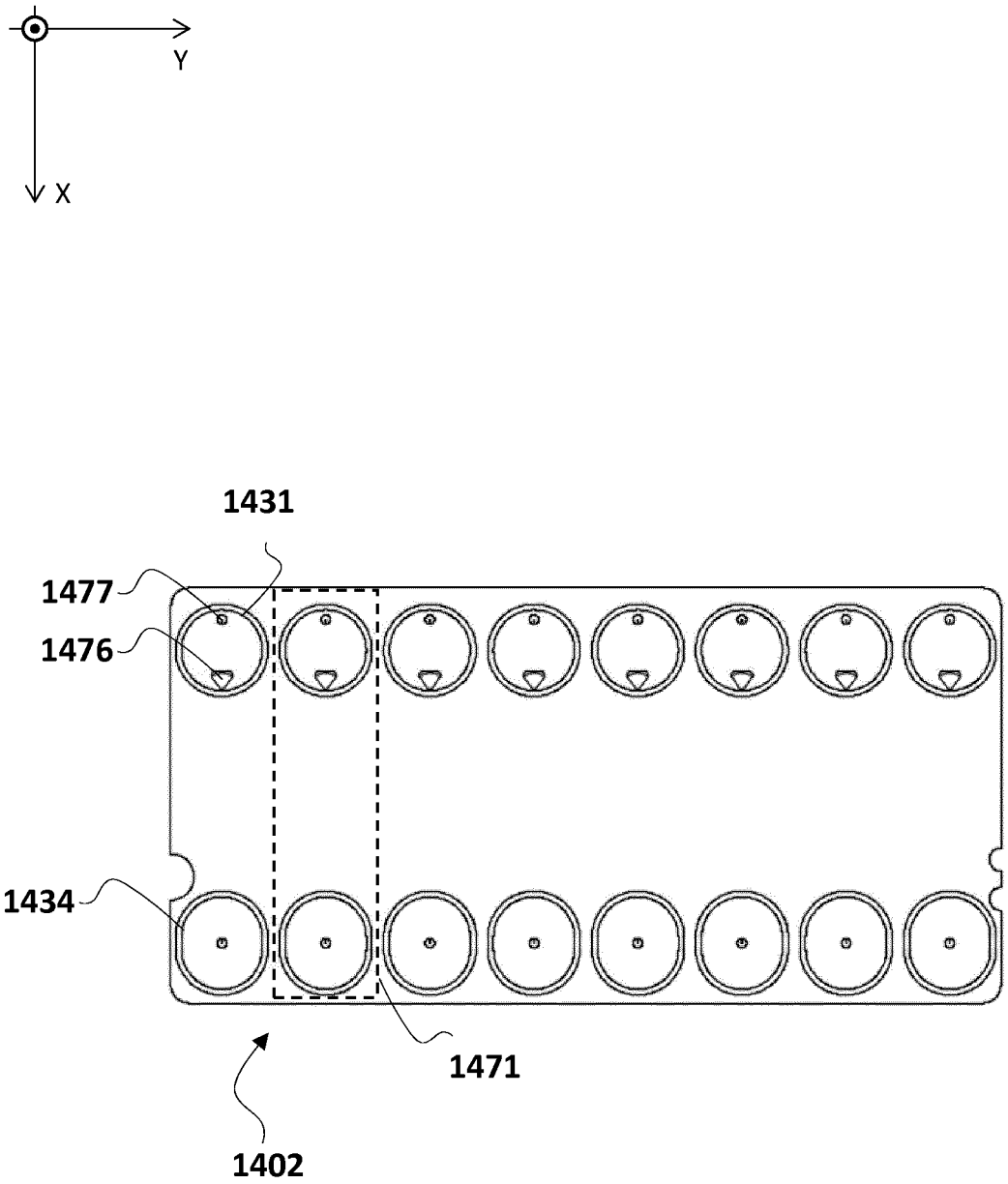

FIG. 15 schematically illustrates a top view of the seventh embodiment of a microfluidic device.

Figure 16:
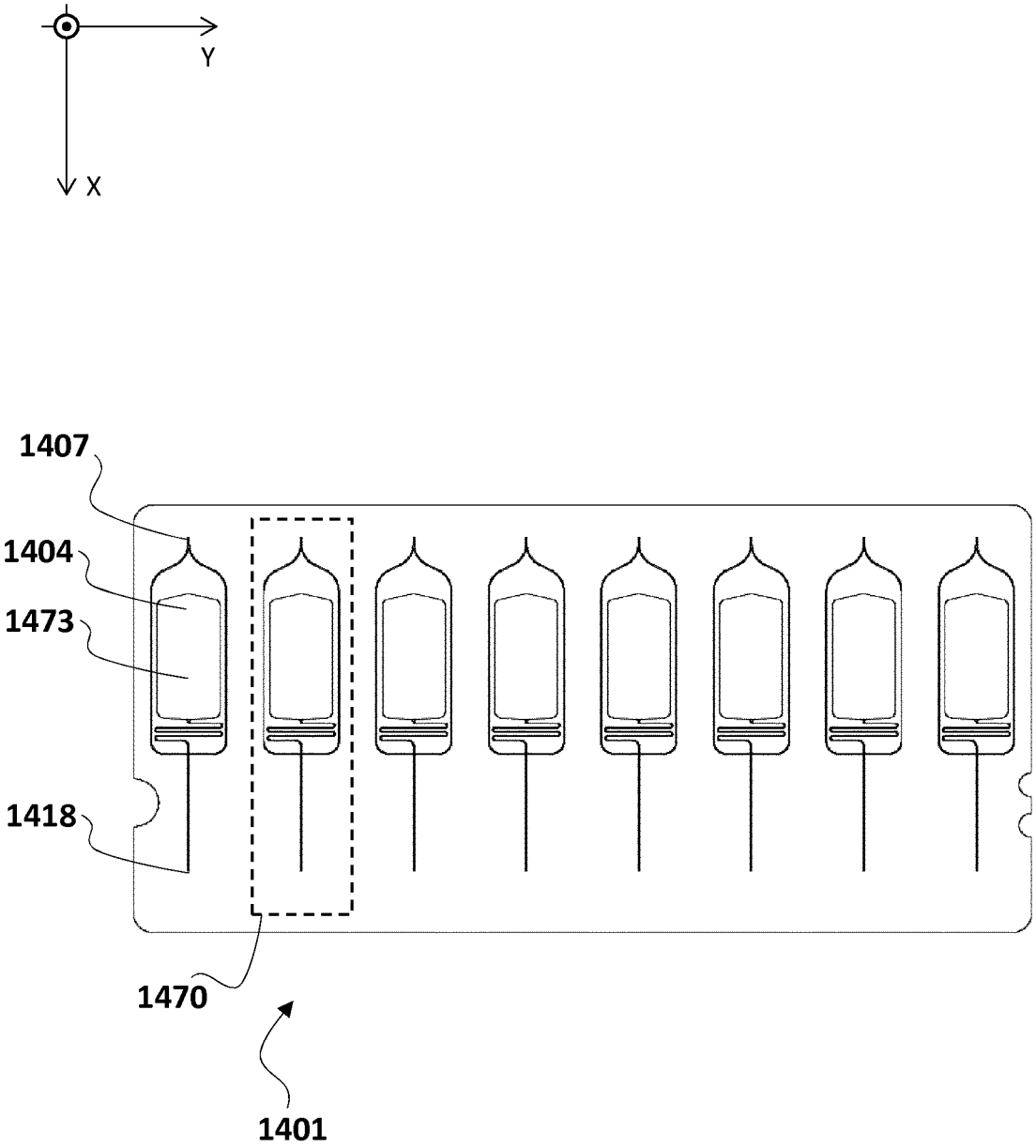

FIG. 16 schematically illustrates a top view of a part of the seventh embodiment of a microfluidic device.

Figure 17:
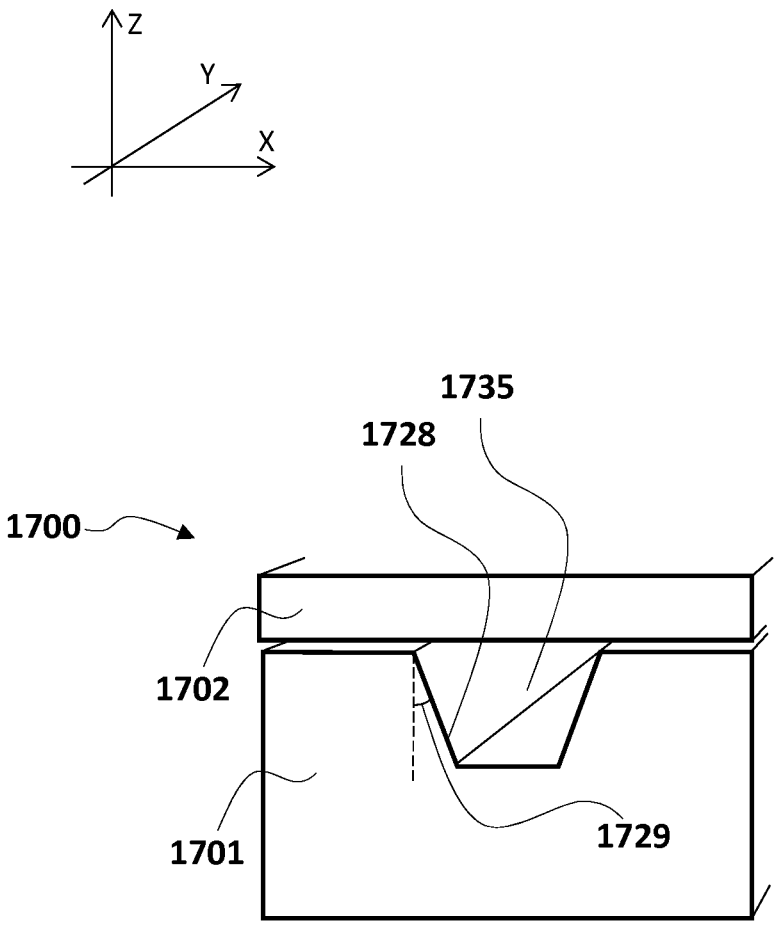

FIG. 17 schematically illustrates an isometric sectional view of a part of a conduit of a microfluidic device according to the present invention.

Figure 18:
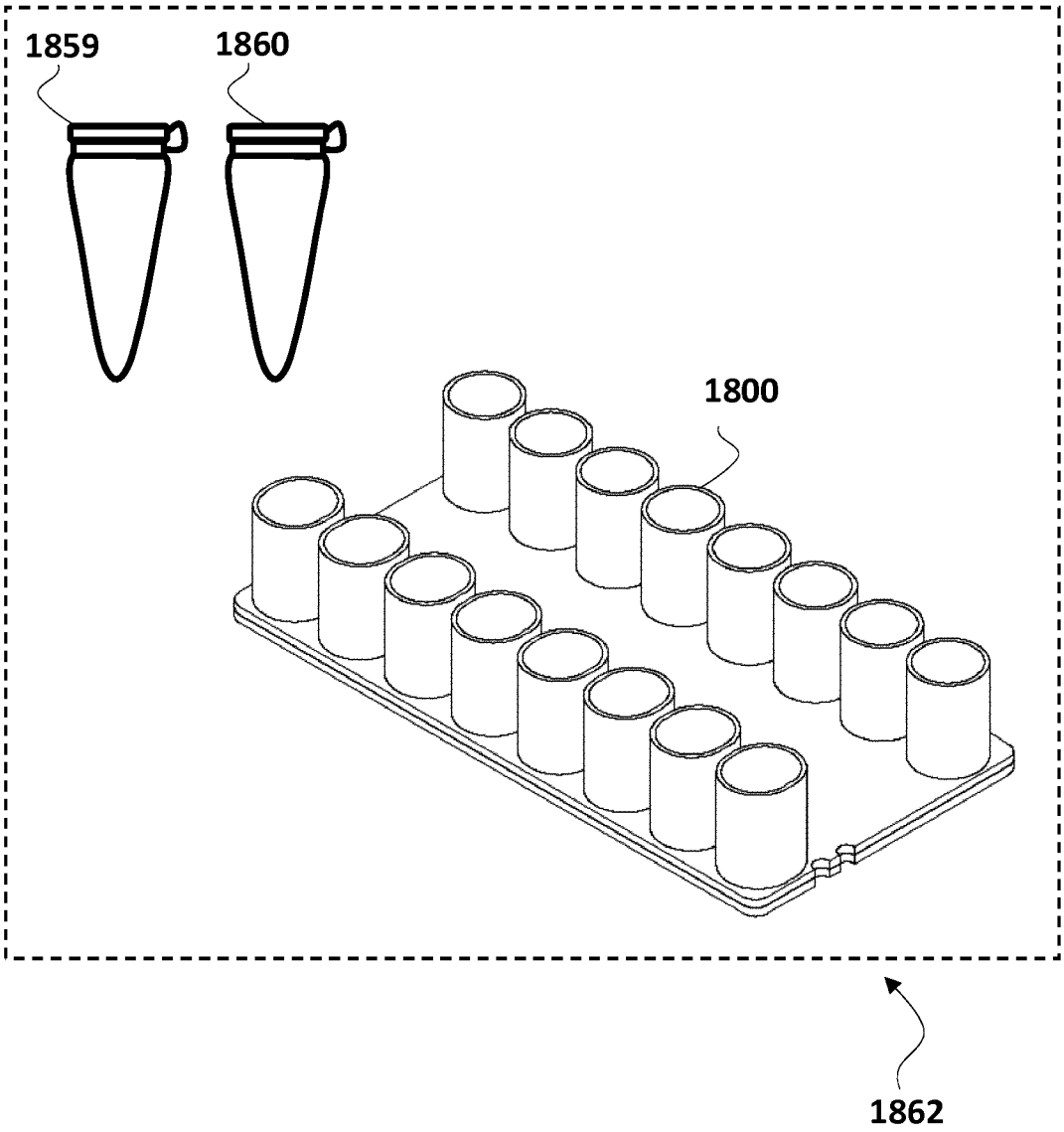

FIG. 18 schematically illustrates a first embodiment of a kit according to the present invention.

Figure 19:
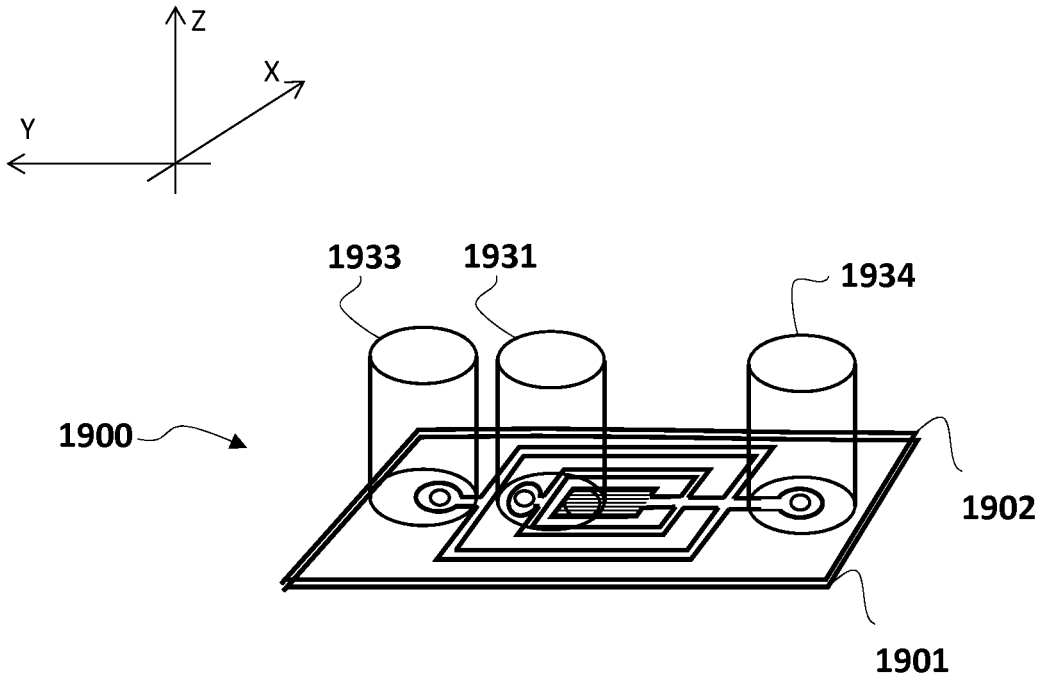

FIG. 19 schematically illustrates a perspective view of an eighth embodiment of a microfluidic device according to the present invention.

Figure 20:
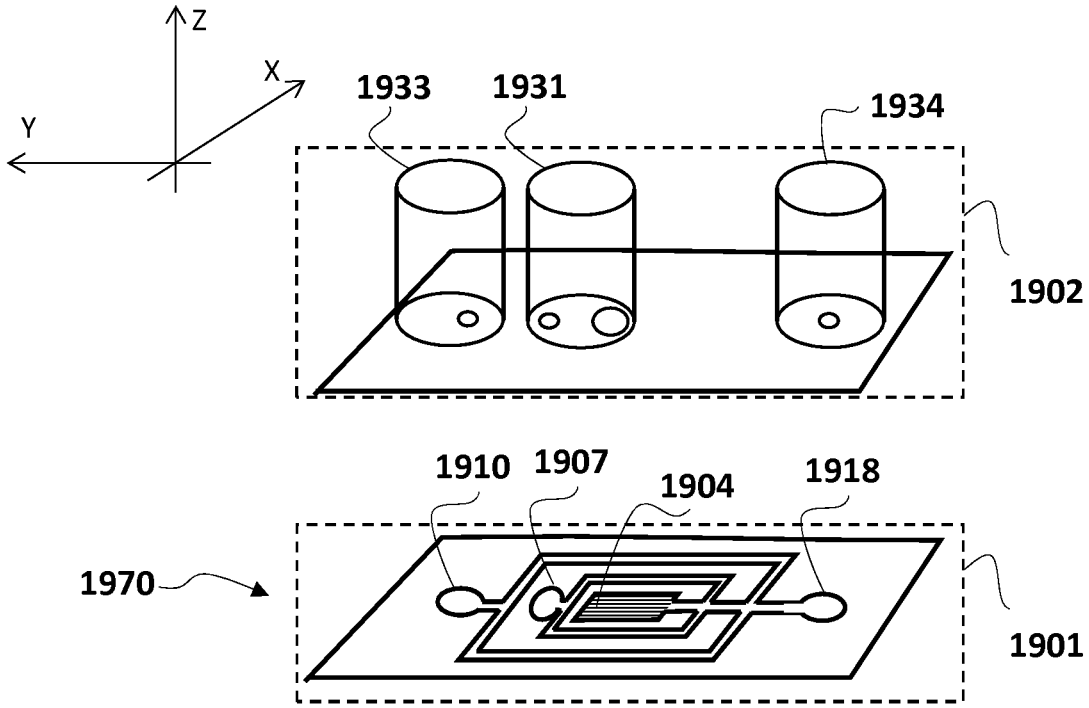

FIG. 20 schematically illustrates a perspective and exploded view of the eighth embodiment of a microfluidic device.

Figure 21:
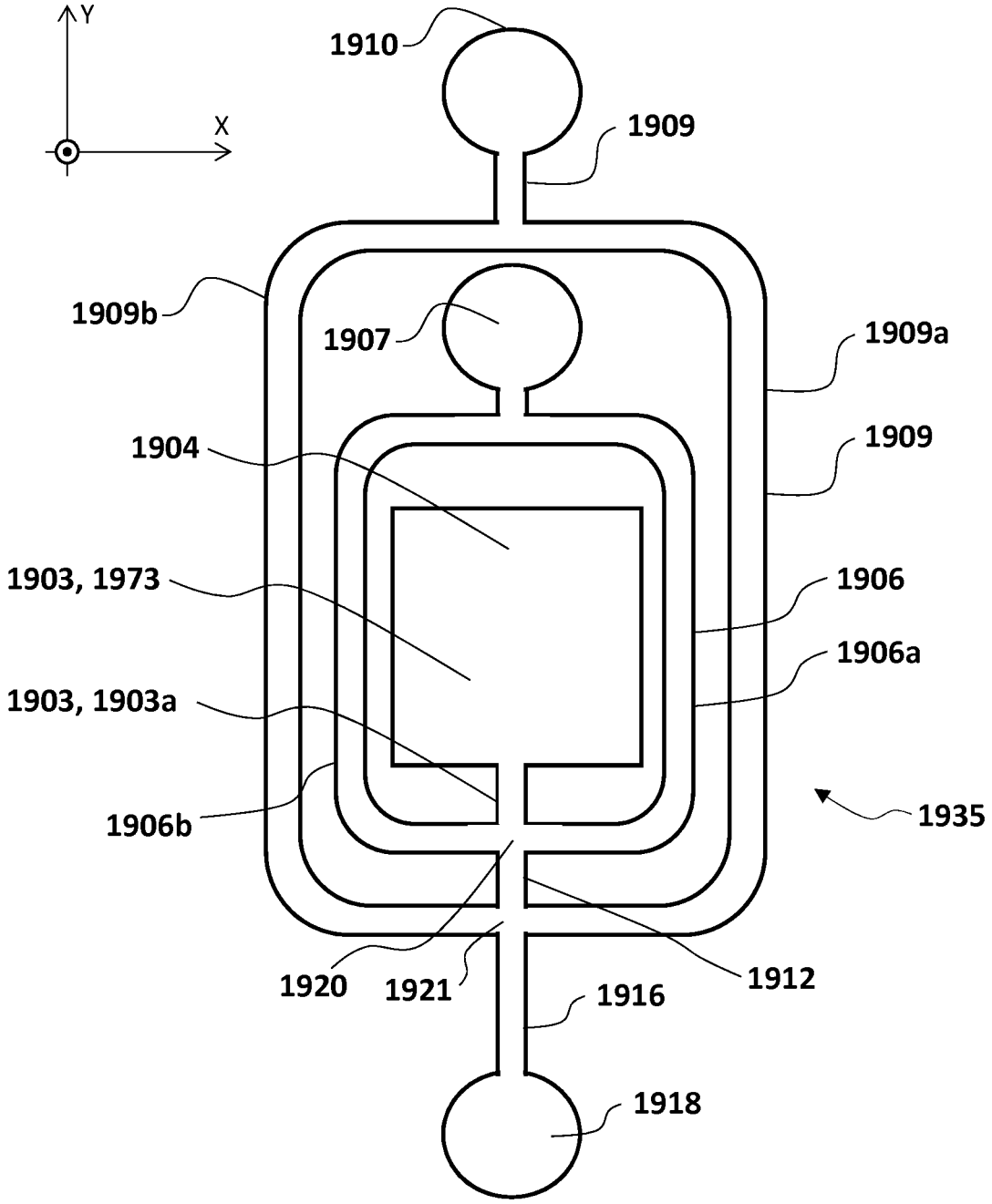

FIG. 21 schematically illustrates a top view of a part of the eighth embodiment of a microfluidic device.

DETAILED DESCRIPTION

Throughout the present disclosure, the term "droplet" may refer to "emulsion droplet", such as provided according to the present invention.

Throughout the present disclosure, the term "example" may refer to an embodiment according to the present invention.

The volume of each fluid conduit network, exclusive of the capillary structure, may be between 0.05 μL and 2 μL, such as between 0.1 μL and 1 μL, such as between 0.2 μL and 0.6 μL, such as around 0.3 μL.

The one or more microfluidic units may comprise a plurality of microfluidic units, such as eight microfluidic units. The one or more groups of wells may comprise a plurality of groups of wells, such as eight groups of wells. The number of microfluidic units provided by a microfluidic device may be equal to the number of groups of wells provided by the microfluidic device. An advantage of the present invention, such as the provision of the plurality of microfluidic units and the corresponding plurality of groups of wells of the microfluidic device, may comprise that individual and/or parallel processing of several samples may be facilitated. The first fluid, which may comprise sample material, may simply be denoted "sample". An advantage of using a method according to the present invention for providing emulsion droplets, wherein the method comprises use of any of: the microfluidic device according to the present invention; or the kit according to the present invention; for the provision of emulsion droplets, may comprise that simultaneous and parallel production of a plurality of droplet emulsions may be achieved which reducing use of time and/or handling. An alternative or additional advantage of using the method according to the present invention may comprise that parallel samples produced using the method may be more homogeneous, which may result in more comparable results from parallel samples.

It may be desired that the second fluid is provided to the first fluid junction before the first fluid is provided to the first fluid junction. This may be to facilitate that even the first part of the first fluid being provided to the first fluid junction may be emulsified. It may be desired that all the first fluid is emulsified.

It may be desired that the capillary structure has a larger volume than the volume of the first fluid as provided to the primary supply well at a time, such as the intended volume of the first fluid to be provided to the primary supply well. This may be to alleviate that any first fluid is provided to the first fluid junction by any capillary action caused by the primary supply conduit, which otherwise may cause that the first fluid is provided to the first fluid junction prior to the second fluid being provided there.

The capillary structure of a microfluidic network may constitute the primary supply conduit. Alternatively, the capillary structure may form part of the primary supply conduit. The primary supply conduit may comprise a connection conduit provided between the capillary structure and the first fluid junction. The connection conduit may be configured to extend the time it takes from a pressure difference is applied between the primary supply well and the collection well and until the first fluid arrives at the first fluid junction. This may facilitate that the second fluid arrives at the first fluid junction before the first fluid, which may in turn result in all of the first fluid being emulsified in the second fluid.

The connection conduit may be provided with a volume which is larger than the volume of the secondary supply conduit. The volume of the connection conduit may be between 0.05 μL and 1 μL, such as between 0.1 and 0.5 μL.

Each fluid conduit network may be configured such that the fluid resistance of the connection conduit is larger than the fluid resistance of the secondary supply conduit.

Parts of a microfluidic network other than the capillary structure, such as one, more or all parts, such as including a possible connection conduit between the capillary structure and the first fluid junction, may exert capillary action/capillary pressure/capillary force on the first fluid.

Processing of the first fluid may refer to emulsification of the first fluid.

The volume of the capillary structure may be defined as the volume of a fluid, e.g. water, which may be contained within the capillary structure.

It may be desired that the capillary structure has a minimal volume, since the volume of the capillary structure may define an upper limit of a volume of the first fluid to be processed at a time. The capillary structure may for instance have a volume of at least 2 μL, 3 μL, 4 μL, 5 μL, 6 μL, 10 μL, 15 μL, 20 μL, 50 μL, or 100 μL. However, there may be several reasons to provide a capillary structure with a maximal volume. The capillary structure may for instance have a volume of at most 1 mL, 500 μL, 400 μL, 200 μL, or 100 μL.

A higher volume of the capillary structure may increase the required minimal outer dimensions of the capillary structure and/or may increase the time it takes for a fluid to be pulled from the primary supply well to the capillary structure and/or may put further requirements to the material used for the capillary structure, such as the material used for the fluid conduit network and/or the structural complexity of the capillary structure. A requirement to the material used may for instance include a requirement regarding the affinity for water for the respective surfaces. Affinity for water may be known as wettability for water. A high affinity for water may refer to high wettability for water. A low affinity for water or lack of affinity for water may refer to a low wettability for water.

Accordingly, a desired volume for the capillary structure may be considered a compromise.

It may be desired that the first fluid, such as water comprising sample, provided to the primary supply well may be drawn completely into the capillary structure within a desired time, such as within 5, 10, or 20 seconds, given that the volume of the first fluid provided to the primary supply well does not exceed the volume of the capillary structure. The time it takes a first volume of e.g. water to be completely drawn into the capillary structure may be denoted "capillary pull time" for that first volume of the first fluid.

Alternatively, or additionally, it may be desired that the volumetric flow rate e.g. for water, which rate may be generated by the capillary structure, has a minimal value. The volumetric flow rate, e.g. for water, generated by the capillary structure may be denoted "capillary flow rate" for that respective fluid.

The capillary flow rate may change in dependence of the capillary structure as the first fluid, e.g. water, is being pulled into the capillary structure.

As a fluid, such as the first fluid, is being pulled by the capillary structure, the capillary flow rate may vary because of any variations in dimensions of the cross-sectional area being defined along the propagation of the surface of the first fluid being pulled by the capillary structure and/or due to any variations of contact angle along the same propagation.

It may be desired to have a maximum capillary pull time for the first fluid, e.g. defined for water, and/or a minimal volumetric flow rate for the first fluid, e.g. defined for water. This may for instance be for limiting or minimizing a possible waiting time between providing the first fluid to the primary supply well and providing the second fluid to the primary supply well. It may be desired to provide the second fluid to the primary supply well after the first fluid has been fully pulled into the capillary structure. This may be to minimize or eliminate the chance that any of the second fluid will be blocking any of the first fluid from entering the capillary structure. Alternatively, or additionally, this may to minimize or eliminate the chance that any of the second fluid is mixed with the first fluid in the first supply conduit and/or the capillary structure.

Alternatively, or additionally, it may be desired to have a maximum capillary pull time for the first fluid, e.g. defined for water, and/or a minimal volumetric flow rate for the first fluid, e.g. defined for water, for facilitating fast transfer of the first fluid to an environment, such as the capillary structure, which may provide an improved environmental control than the primary supply well, e.g. in terms of improved temperature control and/or by providing improved shielding from contamination and/or reactions caused by ambient air and/or particles in the ambient air.

For provision of a microfluidic device, which may enable a desired capillary pull time and/or capillary flow rate, the capillary structure may need to be able to generate a desired capillary force and/or capillary pressure and/or capillary action. Alternatively, or additionally, one or more requirements may be given to the dimensions of any one or more openings provided between the primary supply well and the capillary structure.

Capillary pressure is one of many geometry-related characteristics that may be altered in a microfluidic device to optimize a certain process. For instance, as the capillary pressure increases, a wettable surface in a conduit may pull the liquid through the conduit.

For provision of a desired capillary force and/or capillary pressure and/or capillary action, one or more requirements may be given to e.g. the dimensions of the capillary structure and/or the material used for the capillary structure.

For instance, for a capillary structure having a rectangular cross-section along the extension of the capillary structure, i.e. along the direction of flow, the capillary pressure $p_c$ may be defined as:

$$p_c = 2\gamma \cos\theta\left(\frac{1}{d} + \frac{1}{w}\right)$$

where:

γ is the surface tension of the fluid being pulled by the capillary structure;

θ is the contact angle for the fluid;

d is the depth, i.e. perpendicular to the direction of flow; and w is the width, i.e. perpendicular to the direction of flow and the depth.

Similarly, for a capillary structure in form of a tube, the capillary pressure $p_c$ may be defined as $$p_c = 2\gamma \cos\theta\left(\frac{1}{r_c}\right)$$

where:

γ is the surface tension of the fluid being pulled by the capillary tube;

θ is the contact angle for the fluid; and $r_c$ is the radius of the capillary tube.

For provision of a high capillary pressure, at least one dimension of a cross-sectional area perpendicular to the flow of the first fluid being pulled by the capillary structure may need to be relative small and the contact angle for the respective fluid may need to be sufficiently far below 90°.

As a fluid is being pulled by the capillary structure, the capillary force and/or capillary pressure and/or capillary action and/or capillary flow rate may vary because of any variations in dimensions of the cross-sectional area being defined along the propagation of the surface of the first fluid being pulled by the capillary structure and/or due to any variations of contact angle along the same propagation.

For instance, for facilitation of manufacturing of the microfluidic device, such as in particular the microfluidic section, it may be desired that each capillary structure is provided within a common layer, which may be denoted a "capillary structure layer". Such capillary structure layer may have a longer extension along two orthogonal axes than along a third orthogonal axis.

A length of a capillary structure and/or capillary conduit may be defined as the extension along the intended direction of flow. A width and a depth, respectively, of a capillary structure and/or capillary conduit may be defined orthogonal to each other and orthogonal to the length of the capillary structure and/or capillary conduit. The depth of a capillary structure and/or capillary conduit may be defined along the third axis of the capillary structure layer.

For facilitation of a capillary structure having a desired capillary pressure and having a desired volume, the capillary structure may comprise a capillary conduit having a first cross-sectional dimension, such as a width, being relatively large and a second cross-sectional dimension, such as a depth being relatively small and having an extension being relatively large.

The capillary structure of each microfluidic unit may comprise a first capillary conduit.

Each first capillary conduit may have a width of at least: 2 mm, 3 mm, 4 mm, or 5 mm, and/or at most: 8 mm, 7 mm, or 6 mm. The maximal width of each capillary conduit may e.g. be of relevance for a microfluidic device having a plurality of sample lines being configured for use with a standard multichannel pipette, e.g. a standard multichannel pipette having a nozzle spacing of 9 mm.

Each first capillary conduit may have a depth of at least: 0.02 mm, 0.05 mm, 0.1 mm, 0.25 mm, 0.5 mm, or 0.7 mm, and/or at most: 2 mm, 1.5 mm, 1 mm, or 0.7 mm.

Each first capillary conduit may have a longitudinal extension of at least:

5 mm, 6 mm, 8 mm, 10 mm, 15 mm, or 20 mm, and/or at most: 150 mm, 120 mm, 100 mm, 80 mm, or 50 mm.

Each first capillary conduit may have a cross-sectional area perpendicular to the longitudinal extension of at least: 0.1 $mm^2$, 0.2 $mm^2$, 0.25 $mm^2$, 0.5 $mm^2$, 1 $mm^2$, or 2 $mm^2$, and/or at most 4 $mm^2$.

Each first capillary conduit may be: 0.1 mm to 1 mm deep; 3 mm to 8 mm wide; and 5 mm to 25 mm long.

Each first capillary conduit may be: 0.25 mm to 0.8 mm deep; 4 mm to 7 mm wide; and 7 mm to 15 mm long.

Each first capillary conduit may have rounded corners and/or inclined side walls.

Provision of a first capillary conduit may simplify production of the microfluidic device, e.g. compared to more structural complex solutions.

The capillary structure of each microfluidic unit may comprise a plurality of capillary conduits. The plurality of capillary conduits may be provided in parallel. Each capillary conduit of the plurality of capillary conduits may have a longitudinal extension of at least: 5 mm, 6 mm, 8 mm, 10 mm, 15 mm, or 20 mm, and/or at most: 150 mm, 120 mm, 100 mm, 80 mm, or 50 mm.

Each capillary conduit of the plurality of capillary conduits may define a cross-sectional area perpendicular to the longitudinal extension, wherein the aggregated cross-sectional area of the plurality of capillary conduits is at least: 0.1 $mm^2$, 0.2 $mm^2$, 0.25 $mm^2$, 0.5 $mm^2$, 1 $mm^2$, or 2 $mm^2$, and/or at most 4 $mm^2$.

Provision of a microfluidic unit having a plurality of capillary conduits may facilitate capillary action and/or capillary pressure and/or capillary force, e.g. compared to not having a plurality.

The capillary structure may comprise a wicker or a wicker-like structure.

A combined cross-sectional area of any one or more openings between the primary supply well of each microfluidic unit and the corresponding capillary structure may be at least: 0.2 $mm^2$, 0.4 $mm^2$, 0.5 $mm^2$, 1 $mm^2$, or 2 $mm^2$, and/or at most: 20 $mm^2$, 15 $mm^2$, 10 $mm^2$, or 5 $mm^2$. The combined cross-sectional area of any one or more openings between the primary supply well of each microfluidic unit and the corresponding capillary structure may be may be between 1 and 10 $mm^2$. The combined cross-sectional area of any one or more openings between the primary supply well and the capillary structure may be defined as and/or referred to as the primary supply inlet. The combined cross-sectional area of any one or more openings between the primary supply well and the capillary structure may be provided by a primary through hole of the primary supply well. An advantage of a high cross-sectional area may be to improve the function of the capillary structure. A high cross-sectional area the primary supply well and the capillary structure may enable air to leave the capillary structure while fluid is drawn into the capillary structure. A high cross-sectional area between the primary supply well and the capillary structure may provide a low fluid flow resistance for fluid, such as water, entering the capillary structure.

The primary supply well of each group of wells may comprise a bottom part, such as a flat bottom part. The bottom part may have a primary through hole and a secondary through hole. The primary through hole may provide fluid communication between the primary supply well and the capillary structure of the corresponding microfluidic unit. The secondary through hole may provide fluid communication between the primary supply well and the secondary supply conduit. The primary through hole and the secondary through hole of a primary supply well may be provided at least 2 mm apart, such as at least 3 mm apart, such as at least 5 mm apart. It may be desired to have the primary through hole and the secondary through hole of a primary supply well being provided as far from each other as possible. Accordingly, the width of the bottom part of the primary supply well may determine the possible separation of the primary through hole and the secondary through hole of the primary supply well. The width of the bottom of a primary supply well may for instance be 7 mm in diameter.

The first fluid may be provided, e.g. using a pipette, within and possibly exceeding the primary through hole, but without being provided within the secondary through hole. Accordingly, the first fluid may be pulled into the capillary structure without being pulled into the secondary supply conduit.

The primary through hole may taper towards a side-wall of the primary supply well. This may enable that the end-point of a pipette, which is inserted into the primary supply well and towards the primary through hole, may be directed towards the part of the primary through hole being furthest from the secondary through hole, which may facilitate provision of the first fluid to the capillary structure, such that of the fluid provided to the primary supply conduit may be pulled into the capillary structure.

It may be desired that the capillary structure, such as a least a majority thereof, is configured for provision of a volumetric flow rate for water being at least: 0.5 μL/s, 1 μL/s, 2 μL/s, 3 μL/s, or 10 μL/s. Any part of the primary supply conduit not being configured for such minimal flow rate may be considered not to form part of the capillary structure.

For a conduit having a rectangular cross-section, the volumetric flow rate Q may be stated as:

$$Q=P/R$$

where P is the pressure, such as the capillary pressure, and R is the fluid resistance, which may be stated as:

$$R = 12*eta*L\Big/\left(\left(1-0.63*\frac{h}{w}\right)*h^3*w\right)$$

Where: eta is the dynamic viscosity of the liquid, which for a sample according to the present invention may be that of water; L is the length of the rectangular conduit; h is the height of the rectangular conduit; and w is the width of the rectangular conduit.

The capillary structure may be provided in a plurality of separated parts, e.g. separated by parts of the primary supply conduit that are not configured to provide a minimal capillary flow rate.

The capillary structure may be configured to exert a capillary pressure of at least 20 $N/m^2$, such as at least 40 $N/m^2$, such as at least 50 $N/m^2$.

The capillary structure may be configured to exert a capillary force of at least: 1 μN, 5 μN, 10 μN, 25 μN, 50 μN, or 100 μN.

At least a part of the microfluidic section comprising at least a part of each fluid conduit network may be provided in a material having a contact angle to water of between 50° and 89°.

A desired affinity for water for the capillary structure may be having a contact angle for water of between 50° and 90°, such as between 66° and 76°. The capillary structure may have the same affinity for water as other parts of the fluid conduit network, e.g. by being provided in the same material.

Provision of a contact angle for water of between 50° and 89°, such as between 66° and 76°, for the fluid conduit network of each microfluidic unit may enable a positive capillary pressure within the capillary structure and may enable formation of droplets in the first fluid junction and/or subsequent to the first fluid junction in the direction of flow, such as within the transfer conduit. Provision of a lower contact angle for a fluid conduit network may prevent droplet formation since the first fluid then may stick to the walls forming the conduit at and after the first fluid junction. Provision of a higher contact angle may result in negative pressure in the capillary structure, which may result in the capillary structure not being configured to pull water. Accordingly, the desired contact angle may be considered a compromise.

Examples of materials having a contact angle to water $\theta_{water}$ of between 50° and 89°, which materials may be suitable for the microfluidic section, may comprise any one or more of the following materials, which are listed by name and their respective contact angle to water:

| Material | $\theta_{water}$ |
|---|---|
| Polyvinyl alcohol (PVOH) | 51 |
| Polyvinyl acetate (PVA) | 60.6 |
| Nylon 6 (polycaprolactum, aramid 6) | 62.6 |
| Polyethylene oxide (PEO, PEG, polyethylene glycol) | 63 |
| Nylon 6,6 | 68.3 |
| Nylon 7,7 | 70 |
| Polysulfone (PSU) | 70.5 |
| Polymethyl methacrylate (PMMA, acrylic, plexiglas) | 70.9 |
| Nylon 12 | 72.4 |
| Polyethylene terephthalate (PET) | 72.5 |
| Epoxies | 76.3 |
| Polyoxymethylene (POM, polyacetal, polymethylene oxide) | 76.8 |
| Polyvinylidene chloride (PVDC, Saran) | 80 |
| Polyphenylene sulfide (PPS) | 80.3 |
| Acrylonitrile butadiene styrene (ABS) | 80.9 |
| Nylon 11 | 82 |
| Polycarbonate (PC) | 82 |
| Polyvinyl fluoride (PVF) | 84.5 |
| Polyvinyl chloride (PVC) | 85.6 |
| Nylon 8,8 | 86 |
| Nylon 9,9 | 86 |
| Polystyrene (PS) | 87.4 |
| Polyvinylidene fluoride (PVDF) | 89 |

At least a part of the microfluidic section, such as comprising the base microfluidic piece, may comprise or be made of or provided in poly(methyl methacrylate), abbreviated PMMA. At least a part of the well section, such as comprising the base well structure piece, may comprise or be made of or be provided in PMMA. For instance, the base microfluidic piece and the base well structure piece may be provided in PMMA.

It may be desired to provide at least a part of the microfluidic section and at least a part of the well section in the same material.

PMMA may be advantageous for fabrication because PMMA may be patterned using many different methods relevant both for prototyping and for high volume production, such as injection moulding, laser cutting, and machining.

PMMA may be advantageous for fabrication because it has a low glass transition temperature. Accordingly, it may be bonded at low temperature.

PMMA may be advantageous because it is may be adequately transparent within the visual spectrum to enable visual inspection of the process going on within the microfluidic device, which may be desired.

PMMA may be advantageous because it may be adequately UV-resistant. This may for instance be of relevance for storing in direct sunlight and/or in case of use with coatings requiring a UV curing step during production.

However, it may not be obvious to choose PMMA, since the material may provide disadvantages leading away from choosing this material. These disadvantages may include any one or combination of the following: low chemical resistance, PMMA may for instance not be resistant to solvents such as ethanol; brittleness may be relative high; relative low impact resistance; relative low temperature tolerance, PMMA may not tolerate high temperatures, has a glass transition temperature of 85° C. to 165° C.

The microfluidic device according to the present invention may comprise a base microfluidic piece and a base well structure piece. The base microfluidic piece and the base well structure piece may be provided in the same material, e.g. PMMA.

The base microfluidic piece may form a base part of the microfluidic section. The base microfluidic piece may be provided with a first planar surface having a plurality of ramified recesses providing a base part of each fluid conduit network of the microfluidic device.

The base well structure piece may form a base part of the well section. Sidewalls of each well may be formed protruding extensions of the base well structure piece. The base well structure piece may be formed in one piece, e.g. by being moulded. The base well structure piece may form a second planar surface facing the first planar surface of the base microfluidic piece. The microfluidic device may be provided with an adhesive layer between the first planar surface and the second planer surface. This may facilitate that the well section and the microfluidic section forms a fixedly connected unit and/or that each fluid conduit network do not have any undesired leaks at any boundary between the base microfluidic piece and the base well structure piece and/or facilitate a pressure tight connection. The second planar surface may form part of the microfluidic section. The second planar surface may provide a capping part of each fluid conduit network of the microfluidic device.

One or more parts or all of each fluid conduit network may form an acute trapezoidal cross section, wherein the longer base edge is provided by the capping part. The acute trapezoidal cross section may form an isosceles trapezoidal cross section, wherein the side walls of equal length may have a tapering of at least 5 degrees and/or at most 20 degrees with respect to a normal of either of the parallel base edges.

At least a majority of each capillary structure may be provided at a desired distance from a bottom part of the microfluidic device. This desired distance may be such that any material between at least a majority of the capillary structure and the bottom part of the microfluidic device is less than 5 mm, such as less than 2 mm, such as less than 1 mm.

At least a majority of each capillary structure may be provided within 4 mm, such as within 2 mm, from a bottom part of the microfluidic device.

The microfluidic device may be configured to be placed on and/or coupled with a thermal surface that may provide thermal transfer with the microfluidic device, such as by cooling down the part of the microfluidic device being closest to the thermal surface. A bottom part of the microfluidic device, such as a bottom part of the microfluidic section, may be flat. A bottom part of the microfluidic section may be the part furthest from and/or facing away from the well section. A flat bottom part of the microfluidic device may be placed on a flat thermal surface. If for instance the first fluid is an aqueous fluid comprising a sample which is provided to an initially empty primary supply well, the first fluid may be drawn into the capillary structure by capillary forces. A cold thermal surface may provide thermal transfer with the first fluid, e.g. comprising a sample, which may be heat sensitive. Accordingly, a reaction may be prevented or impeded from starting until the first fluid is emulsified. If the entire microfluidic device is cooled, then the second fluid, e.g. oil, will also be cold, will become more viscous, and the flow rate hereof will decrease or stop completely, which will hinder or make emulsification of the first fluid difficult.

An advantage with the present invention may be facilitation or impediment of some reactions which may occur to a fluid contained by the microfluidic device prior to formation of emulsions. It may for instance be desired that the different fluids used with the microfluidic device are kept at different temperatures, e.g. at least until emulsion of the fluids are provided by means of the device. For instance, it may be desired that the first fluid, such as a water based fluid, such as comprising a sample, is kept at a lower temperature than the second fluid, such as an oil based fluid. The first fluid may comprise a heat sensitive sample. A sample may for instance be heat sensitive since a reaction within the sample may be triggered and/or intensified by heat, which may be undesired to occur prior to the formation of emulsions. It may be desired that the second fluid has a higher temperature than the first fluid, e.g. it may be desired that the second fluid is at room temperature, such as around 20° C., since the viscosity of e.g. oil may increase with decreased temperature, which may prevent or impede the oil from flowing through a respective fluid conduit network of the microfluidic device and/or which may require higher force, such as a higher applied pressure, for driving the oil through the fluid conduit network. The microfluidic device according to the present invention may facilitate some or all of the above-mentioned, in particular by provision of the capillary structure in combination with the primary supply well according to the present invention.

A part of the primary supply conduit being provided at the primary supply well may be denoted "primary supply inlet".

A part of the secondary supply conduit being provided at the primary supply well may be denoted "secondary supply inlet".

A part of the fluid conduit network being provided at the collection well may be denoted "collection outlet".

The microfluidic device according to the present invention may be configured for provision of multiple emulsions, such as double emulsion. The plurality of supply conduits of each fluid conduit network may comprise a tertiary supply conduit. Each microfluidic unit may comprise a collection conduit and a second fluid junction. The second fluid junction of each microfluidic unit may provide fluid communication within the corresponding fluid conduit network between the tertiary supply conduit, the transfer conduit, and the collection conduit. The transfer conduit of each fluid conduit network may comprise a first transfer conduit part having a first affinity for water and extending from the corresponding first fluid junction. The collection conduit of each fluid conduit network may comprise a first collection conduit part extending from the corresponding second fluid junction and having a second affinity for water being different from the first affinity for water. The one or more supply wells of each group of wells may comprise a tertiary supply well being in fluid communication with the tertiary supply conduit of the corresponding microfluidic unit. The collection well may be in fluid communication with the transfer conduit of the corresponding microfluidic unit via the collection conduit of the corresponding microfluidic unit.

An advantage of the present invention, such as provision of the first transfer conduit part having a first affinity for water and the first collection conduit part having a second affinity for water being different from the first affinity for water, may comprise that double emulsion droplets may be produced within one microfluidic unit. This may in turn result in more uniform and/or monodisperse droplets. Connecting two individual microfluidic parts having different surface properties, as may be provided according to prior art solutions, may result in a flow of droplets with unequal spacing between the droplets, which may result in production of polydisperse droplets.

An enzyme having significant activity at room temperature may advantageously be used and/or provided with the present invention. A contact to a cold thermal surface may provide thermal transfer with the first fluid containing an enzyme and thereby impede the reaction until the first fluid is emulsified. The enzyme according to the present invention may consist of or comprise a polymerase such as a multiple displacement amplification polymerase, such as Phi29, a ligase, or a restriction enzyme such as Cas9.

The method according to the present invention for providing emulsion droplets may comprise use of the microfluidic device according to the present invention. The method may comprise providing the first fluid to the primary supply well of a first group of wells and subsequently providing the second fluid to the primary supply well of the first group of wells and subsequently providing a pressure difference between the primary supply well of the first group of wells and the collection well of the first group of wells, such that the pressure within the primary supply well of the first group of wells is higher than within the collection well of the first group of wells.

Accordingly, the pressure difference between the primary supply well of the first group of wells and the collection well of the first group of wells may: provide a primary flow of the first fluid from the capillary structure of the corresponding microfluidic unit to the corresponding first fluid junction; and provide a secondary flow of the second fluid from the primary supply well of the first group of wells to the first fluid junction via the secondary supply conduit.

The primary flow and the secondary flow may provide a collection flow of the first fluid and the second fluid to the collection well via the transfer conduit.

An advantage with the present invention may be that application of pressure difference between the one or more supply wells and the collection well may be simpler and/or easier, e.g. compared to a microfluidic device having more wells, e.g. for each sample line, than the microfluidic device according to the present invention.

Each fluid conduit network may comprise: a plurality of supply conduits; a transfer conduit; a collection conduit; a first fluid junction; and a second fluid junction. The plurality of supply conduits may comprise a primary supply conduit, a secondary supply conduit, and a tertiary supply conduit. The transfer conduit may comprise a first transfer conduit part having a first affinity for water. The collection conduit may comprise a first collection conduit part having a second affinity for water being different from the first affinity for water. The first fluid junction may provide fluid communication between the primary supply conduit, the secondary supply conduit, and the transfer conduit. The first transfer conduit part may extend from the first fluid junction. The second fluid junction may provide fluid communication between the tertiary supply conduit, the transfer conduit, and the collection conduit. The first collection conduit part may extend from the second fluid junction.

Each group of wells may comprise a plurality of wells comprising a collection well and a plurality of supply wells. The plurality of supply wells may comprise a primary supply well and a tertiary supply well. The well section and the microfluidic section may be fixedly connected to each other. Each group of wells may be fixedly connected to a respective corresponding microfluidic unit.

The collection well of each group of wells may be in fluid communication with the collection conduit of the corresponding microfluidic unit. Accordingly, the collection conduit may provide fluid communication between the collection well and the second fluid junction.

The primary supply well of each group of wells may be in fluid communication with the primary supply conduit of the corresponding microfluidic unit.

Accordingly, the primary supply conduit may provide fluid communication between the primary supply well and the first fluid junction.

The tertiary supply well of each group of wells may be in fluid communication with the tertiary supply conduit of the corresponding microfluidic unit.

Accordingly, the tertiary supply conduit may provide fluid communication between the tertiary supply well and the second fluid junction.

The primary supply well of each group of wells may be in fluid communication with the secondary supply conduit of the corresponding microfluidic unit.

Accordingly, the secondary supply conduit may provide fluid communication between the one supply well and the first fluid junction.

The microfluidic device according to the present invention may be denoted "cartridge" or "microfluidic cartridge". A first part of the microfluidic device, comprising the plurality of microfluidic units, may be denoted "microfluidic section". A second part of the microfluidic device, comprising the plurality of groups of wells, may be denoted "well section". The second part of the microfluidic device may be different from and may not comprise the first part of the microfluidic device. The microfluidic section and/or a microfluidic unit may be denoted "chip", "microchip", or "microfluidic chip".

The base microfluidic piece may be formed in one piece, such as being moulded, such as being provided via injection-moulding. The base microfluidic piece may form part of the microfluidic section. The base microfluidic piece may comprise each microfluidic unit of the microfluidic device.

The base well structure piece may be formed in one piece, such as being moulded, such as being provided via injection-moulding. The base well structure piece may form part of the well section. The base well structure piece may comprise each well of the microfluidic device.

The microfluidic section and the well section may be fixedly connected to each other.

Each microfluidic unit may form a fluid connection between the individual wells of the corresponding group of wells. A group of wells and a microfluidic unit may be denoted "corresponding" if fluid connection is provided between them. Each group of wells of the plurality of group of wells may form part of a functional unit in combination with the respective corresponding microfluidic unit of the plurality of microfluidic units. Such functional unit may be denoted "droplet generating unit" and/or "sample line". The sample lines may be isolated from each other such that any sharing of liquids is prevented.

Provision of a plurality of sample lines may facilitate individual and/or parallel processing of several samples.

The microfluidic device may be intended for single use, i.e. each sample line may be intended to be used only once. This may provide a low risk of contamination of results.

The term "microfluidic" may imply that at least a part of the respective device/unit comprises one or more fluid conduits being in the microscale, such as having at least one dimension, such as width and/or height, being smaller than 1 mm and/or a cross-sectional area smaller than 1 $mm^2$. The smallest dimension, such as a height or a width, of at least one part of the fluid conduit network, such as a conduit, an opening, or a junction, may be less than 500 μm, such as less than 200 μm.

The term "microfluidic" may imply that the volume of the respective part is relative small. The volume of each fluid conduit network, exclusive of any capillary structure, may be between 0.05 μL and 2 μL, such as between 0.1 μL and 1 μL, such as between 0.2 μL and 0.6 μL, such as around 0.3 μL.

The behaviour of fluids at the microscale, such as may be provided by the fluid conduit network of the device of the present invention, may differ from "macrofluidic" behaviour in that factors such as surface tension, energy dissipation, and/or fluidic resistance may start to dominate the system. At small scales, such as when a conduit according to the present invention, such as the transfer conduit, has a diameter, height, and/or width of around 100 nm to 500 μm, the Reynolds number may become very low. A key consequence hereof may be that co-flowing fluids do not necessarily mix in the traditional sense, as flow may become laminar rather than turbulent. Consequently, when two immiscible fluids, e.g. the first fluid, such as an aqueous phase, and e.g. the second fluid, such as an oil phase, meet at a junction, parallel laminar flows may result, which again may result in stable production of monodisperse droplets. At a larger scale, the immiscible liquids may mix at the junction, which may result in polydisperse droplets.

The microfluidic device according to the present invention may be configured for provision of double emulsion droplets. Double emulsion droplets may refer to droplets wherein an inner, dispersed phase is surrounded by an immiscible phase which again is surrounded by a continuous phase. The inner dispersed phase may comprise and/or consist of one droplet. The inner phase may be an aqueous phase in which salts, nucleotides, and enzymes may be or is dissolved. The immiscible phase may be an oil phase. The continuous phase may be an aqueous phase.

The microfluidic device according to the present invention may be configured for triple emulsions, quadruple emulsions, or a higher number of emulsions.

The microfluidic device may comprise an upper side and a lower side. The upper side may be configured for accessing each well, e.g. by means of a pipette.

The plurality of microfluidic units may comprise and/or consist of eight microfluidic units. An advantage of provision of exactly eight units may be facilitation of use of state of the art equipment, such as an 8-channel pipette.

A lower part and/or an upper part of each microfluidic unit may be provided by the base microfluidic piece.

The fluid conduit network may form a network of conduits that intersect at junctions, comprising the first fluid junction and the second fluid junction.

Any one or more conduits of the fluid conduit network may comprise one or more parts, such as channels, having substantially uniform diameter.

A diameter of any part of the fluid conduit network may refer to the width and/or height and/or any other cross-sectional dimension of the fluid conduit network.

The fluid conduit network may comprise conduits having a varying diameter. Parts of the fluid conduit network having a relative high diameter may provide transport of liquid at a relative low resistance resulting in higher volumetric flow. Parts of the fluid conduit network having a relative small diameter may enable provision of a desired size of the generated droplets.

A cross sectional area of a part of the fluid conduit network, such as of a conduit thereof, may refer to the area of a cross section defined perpendicular to the one or more walls of e.g. the respective conduit or at least one wall part of e.g. the respective conduit.

The fluid conduit network may comprise conduits having a varying cross-sectional area. Parts of the fluid conduit network having a relative large cross-sectional area may provide transport of liquid at a relative low resistance resulting in higher volumetric flow e.g. at application of different pressure at opposing ends of a conduit. Parts of the fluid conduit network having a relative small cross-sectional area may enable provision of a desired size of the generated droplets.

The first transfer conduit part may have a cross-sectional area of 150-300 $\mu m^2$ and the first collection conduit part may have a cross-sectional area of 200-400 $\mu m^2$. This may facilitate that the droplets generated have a diameter of the inner droplet of 10 to 25 μm and an outer total diameter of the inner droplet plus shell layer of 18 to 30 μm.

The fluid conduit network may comprise nozzles and/or chambers. A nozzle may comprise a constriction in a conduit of smaller cross-sectional area than the conduit on both sides of the nozzle. A nozzle may facilitate production of a smaller size droplet than what otherwise could be expected from the conduit cross-sectional area. This may in turn enable use of conduits having larger cross-sectional area with lower resistance. A chamber may be an area within the microfluidic unit designed to hold a volume of liquid to delay the liquid or to temporarily store liquid within the microfluidic unit. Such a chamber may be an advantage as it may delay liquid from one or more conduits relative to other conduits which may ensure the correct timing of liquids at the respective junctions.

A supply conduit of a microfluidic unit may refer to any one, more, or all of the following: the primary supply conduit, the secondary supply conduit, and the tertiary supply conduit.

A supply inlet of a microfluidic unit may refer to any one, more, or all of the following: the primary supply inlet, the secondary supply inlet, and the tertiary supply inlet.

A supply opening of a microfluidic unit may refer to any one, more, or all of the following: the primary supply opening, the secondary supply opening, and the tertiary supply opening.

A conduit of a microfluidic unit may refer to any one, more, or all of the following: the transfer conduit, the collection conduit, the primary supply conduit, the secondary supply conduit, and the tertiary supply conduit.

An opening of a conduit of a microfluidic unit may refer to any one, more, or all of the following: the first transfer opening, the second transfer opening, the collection opening, the primary supply opening, the secondary supply opening, and the tertiary supply opening.

An opening of a conduit may be defined as the narrowest part of the respective conduit provided at a junction. The opening may be positioned close to the junction such as within 1 mm of the junction and may be narrower or have essentially the same cross-sectional area as the conduit leading into or out of the junction. The opening may be followed by a widening into the junction or have essentially the same cross-sectional area as the junction. An opening may comprise one or more holes or slits.

The first fluid junction and/or the second fluid junction may be denoted "fluid junction". Each fluid junction may be defined by a plurality of openings of conduits, which conduits may be considered to intersect or meet each other.

Each fluid junction may comprise a plurality of openings for leading fluid into the junction and one opening for leading fluid out of the junction.

Each fluid junction may enable immiscible fluids from two or more conduits to come into direct fluid contact and interact. Accordingly, a stream of alternating liquid portions or plugs or droplets may be provided. While within a relative narrow conduit, a droplet may be oblong and may be considered to be a plug.

Formation of droplets or plugs comprising double emulsion droplets or plugs may be initiated starting from the second fluid junction and may be completed within or after the junction in the direction of the fluid exiting the junction, i.e. along the collection conduit.

The first transfer conduit part may be a part of the transfer conduit where droplets or plugs formed from a first liquid being immiscible with a second liquid. The first transfer conduit part may have a first affinity for water that enables formation and/or sustainability of droplets in the first transfer conduit part. This first affinity for water may correspond to hydrophobic properties allowing formation of water droplets or plugs in oil such as fluorocarbon oil.

Affinity for water may be known as wettability for water. A high affinity for water may refer to high wettability for water. A low affinity for water or lack of affinity for water may refer to a low wettability for water.

The first collection conduit part may be a part of the collection conduit where an emulsion comprising double emulsion droplets or plugs is formed. The first collection conduit part may have a second affinity for water that enables formation and/or sustainability of double emulsion droplets in the first collection conduit part. This second affinity for water may correspond to hydrophilic properties allowing formation of aqueous droplets or plugs surrounded by an oil shell in a continuous aqueous phase.

The secondary supply conduit may comprise a second secondary supply conduit. Such second secondary supply conduit may be extending from the secondary supply inlet to a second secondary supply opening. The first plurality of openings of the first fluid junction may comprise the second secondary supply opening. Provision hereof may improve generation of droplets by pinching from more than one side at the first junction.

Accordingly, pinching of the second fluid onto the first fluid may be carried out from the first fluid junction by means of the combination of the first secondary supply conduit and the second secondary supply conduit, which both may extend between the primary supply well and the first supply conduit.

Any pinching parts, such as the first secondary supply conduit and the second secondary supply conduit, may be configured to have the same fluid resistance for the respective fluid, e.g. the second fluid. This may be to facilitate uniform effect within and after the respective fluid junction. Any pinching parts may be configured to have the same volume to facilitate that the respective fluid, e.g. the second fluid, will arrive to the respective fluid junction, e.g. the first fluid junction, at the same time. Accordingly, pinching of the third fluid onto the mixture of the first fluid and the second fluid may be carried out from the second fluid junction by means of the combination of the first tertiary supply conduit and the second tertiary supply conduit, which both may extend between the tertiary supply well and the second supply conduit.

The tertiary supply conduit may comprise a second tertiary supply conduit. Such second tertiary supply conduit may be extending from the tertiary supply inlet to a second tertiary supply opening. The second plurality of openings of the second fluid junction may comprise the second tertiary supply opening. Provision hereof may improve generation of droplets by pinching from more than one side at the second junction.

The first transfer conduit part may extend to the second transfer opening. Alternatively, the transfer conduit may comprise a second transfer conduit part, e.g. extending from a second end of the first transfer conduit part, which second end may be opposite of the first transfer opening, and e.g. extending to the second transfer opening. Such second transfer conduit part may have an affinity for water being different from the first affinity for water.

For one or more embodiments, a part of the transfer conduit and/or a part of the collection conduit may have further supplies of fluid.

The first collection conduit part may be extending to the collection outlet.

The first transfer conduit part may refer to a first zone immediately following the first fluid junction along the intended direction of the fluid flow where formation of aqueous droplets in oil carrier fluid may occur.

The first collection conduit part may refer to a second zone immediately following the second fluid junction in the intended direction of the fluid flow where formation of double emulsion aqueous droplets surrounded by an oil shell in an aqueous carrier fluid may occur.

Formation of single emulsions of the first fluid emulsified in the second fluid may be initiated at first junction and may be continued within the first transfer conduit part. Accordingly, after the first transfer conduit part, the first fluid may be in the dispersion phase, whereas the second fluid is in the continuous phase. Formation of double emulsions may be initiated at second junction and may be continued within first collection conduit part. Accordingly, after the first collection conduit part, the third fluid may be in the continuous phase and may be emulsifying the second fluid, which may form a shell layer around the first fluid.

The first affinity for water may be defined as having a lack of affinity for water, i.e. such as being hydrophobic. The first affinity for water may describe a surface having a contact angle for water of more than 60°, such as more than 65°, such as more than 70°, such as more than 90°. A higher contact angle may provide a more stable provision of droplets, i.e. such as single emulsion water-in-oil droplets. This in turn may enable a wider range of pressures to be utilized and/or a higher percentage of double emulsion droplets provided according to desired dimensions.

A contact angle may be measured on a surface as described in Yuan Y., Lee T. R. (2013) Contact Angle and Wetting Properties. In: Bracco G., Hoist B. (eds) Surface Science Techniques. Springer Series in Surface Sciences, vol 51. Springer, Berlin, Heidelberg. A contact angle within a closed volume, such as a conduit, may be measured as described in Tan, Say Hwa et al.

Oxygen Plasma Treatment for Reducing Hydrophobicity of a Sealed Polydimethylsiloxane Microchannel. Biomicrofluidics 4.3 (2010): 032204. PMC.

The second affinity for water may be defined as having a strong affinity for water, i.e. such as being hydrophilic. The second affinity for water may describe a surface having a contact angle of less than 60°, such as less than 55°, such as less than 50°, such as less than 40°, such as less than 30°. A lower contact angle may provide a more stable provision of double emulsion droplets, i.e. e.g. water-in-oil-in-water double emulsion droplets. This in turn may enable a wider range of pressures to be utilized and/or a higher percentage of double emulsion droplets provided according to desired dimensions.

Having one affinity for water being different form another affinity for water may be understood as having an opposite affinity for water or an oppositely defined affinity, such as high vs. low. For instance, if the first affinity for water is hydrophobic, then the second affinity for water may be hydrophilic, and vice versa.

Provision of the first affinity for water may for instance be provided by polymers such as PMMA (Poly(methyl methacrylate)), Polycarbonate, Polydimethylsiloxane (PDMS), COC Cyclic Olefin Copolymer (COC) e.g. including also TOPAS, COP Cyclo-olefin polymers (COP) including ZEONOR®, Polystyrene (PS), polyethylene, polypropylene, and negative photoresist SU-8.

Provision of the first affinity for water may alternatively, or additionally, be provided by a material such as glass e.g. treated using a method to make the surface hydrophobic, such treated as using siliconization, silanization, or coating with amorphous fluoropolymers.

Provision of the first affinity for water may alternatively, or additionally, be provided by coating the surface to make it hydrophobic by applying a layer of Aquapel, sol-gel coating, or by deposition of thin films of gaseous coating material.

Provision of the second affinity for water may for instance be provided by materials including glass, silicon, or other materials providing hydrophilic properties.

Provision of the second affinity for water may alternatively, or additionally, be provided by modifying the surface using oxygen plasma treatment, UV irradiation, UV/ozone treatment, UV-grafting of polymers, Deposition of Silicon dioxide (SiO2), deposition of thin films such as Silicon dioxide by chemical vapor deposition (CVD) or PECVD.

Any supply well or collection well may be referred to as "a well". The term "well" may refer to any one, more, or all of the following: the collection well, the primary supply well, and the tertiary supply well.

A well may be a structure, such as a container, suitable for accepting and containing a liquid, e.g. such as an aqueous sample, an oil, a buffer, or an emulsion.

A well may have one or more openings. One opening may be configured for providing or extracting liquid to or from the well, e.g. by top-loading/extracting using a pipette. Another opening may enable liquid held by the respective well to exit the well either passively, such as through capillary forces, and/or actively, such as when subjected to a pressure difference.

A well may be provided with different openings enabling different liquids to exit a well, e.g. one liquid may exit a well by means of capillary forces, while another liquid, which may be provided to the respective well subsequently to the one liquid, may exit the well through another opening and by means of a pressure difference.

A well may be bounded in one, two or three dimensions such as being essentially flat, being circumferentially bounded, or being bounded in all dimensions such as a blister.

The primary supply well may be configured for holding a first fluid, such as a sample buffer. A fluid held by the primary supply well may be guided by the corresponding microfluidic unit towards the corresponding collection well.

The tertiary supply well may be configured for holding a third fluid, such as a buffer. A fluid held by the tertiary supply well may be guided by the corresponding microfluidic unit towards the corresponding collection well.

The one supply well of the plurality of supply wells, which is in fluid communication with the secondary supply inlet of the corresponding microfluidic unit, may be the primary supply well. This one supply well, such as the primary supply well, may be configured for holding a second fluid, such as oil. A fluid held by this one supply well may be guided by the corresponding microfluidic unit towards the corresponding collection well.

The collection well may be configured for collecting the fluids from the supply wells. This fluid may comprise double emulsion droplets provided by the device according to the present invention during use. The double emulsion droplets may be suspended in a continuous fluid, such as a buffer.

The primary supply well may be configured to contain a first supply volume. The tertiary supply well may be configured to contain a third supply volume. The collection well may be configured to contain a collection volume. The collection volume may be larger, such as at least 5% larger, than the sum of the volumes contained by the corresponding supply wells, such as the first supply volume, the second supply volume, and the third supply volume.

The first supply volume may e.g. be between 100 and 500 μL, such as between 200 and 400 μL.

The third supply volume may e.g. be between 150 and 800 μL, such as between 300 and 500 μL.

The collection volume may e.g. be between 250 and 1000 μL, such as between 400 and 800 μL.

During use of the device according to the present invention, liquid may be transferred from each of the supply wells to the collection well.

Liquid contained by the collection well may be collected using a pipette. When a tip of a pipette is inserted into the collection well for collecting liquid, then liquid may be displaced by the pipette tip. Accordingly, having a collection volume being larger than the sum of the volumes contained by the supply wells may prevents overflow of liquid from the collection well during collection hereof.

A bottom part of the first supply well may be rounded. This may be for ensuring essentially complete entry of the first liquid contained by the first supply well into the corresponding microfluidic unit when pressure is applied to the well. Since the first liquid may contain a sample, it may be advantageous that all or essentially all the first liquid is utilized.

The wells, e.g. each supply well or each well of each group of wells, may for instance be provided in a grid, such as rows and columns, where the spacing between adjacent wells may be the same along two orthogonal directions.

The wells, e.g. each supply well or each well of each group of wells, may be provided in a standard well plate layout, such as defined as published by American national standard institute on behalf of Society for Biomolecular Screening. Accordingly, the distance between the center of adjacent wells in any of two orthogonal directions may be 9 mm.

The distance between the center of the first supply wells of adjacent microfluidic units may be 9 mm.

The wells may for instance have any suitable shape, such as a cylinder with a round opening at the top. The wells may be tapered towards the bottom of the well, i.e. with a larger opening at the top than at the bottom. An advantage of a tapered well or a tapered bottom of the well may be to assure a complete withdrawal of the liquids during operation. The opening of the wells at the top may have a size suitable for dispensing and removing liquids using a standard micropipette.

The top of each well may be at the same level. This may facilitate provision/extraction of fluid from the respective wells.

The bottom of the collection well may be provided at a lower level than the collection outlet. An advantage hereof may be that double emulsion droplets may be moved from the fluid conduit network into a part of the collection well that may be isolated from the fluid conduit network in order to prevent backflow of double emulsion droplets in the fluid conduit network. Accordingly, low droplet loss may be provided. The volume of the lower part, e.g. bottom part, of the collection well may be at least 200 μL.

A lower part and/or an upper part of each group of wells may be provided by the base well structure piece.

The top of the base well structure piece may accommodate a substantially flat gasket.

The gasket may be a separate part and the base well structure piece may have features/protrusions that allow the reversible fixation of the gasket. Protrusions may have any suitable shape and size. In some embodiments, each column might have a set of protrusions. An advantage hereof may be that only a single or a defined number of columns may be opened at a time.

A set of protrusions may be constituted by any number of protrusions such as one, a pair or more. A pair of protrusion may comprise two identical structures or two different structures such as a hook and a pin. An advantage of using a pair of protrusions may be to enable the opening of for example only the outlet well.

The top of each well may have a heightening of any suitable size, such as 1 or 2 mm in height and width. The heightening may be uniform in height and width along the borders of all wells such as the lip shown in the example. An advantage of the heightening may be to facilitate a correct seal with the gasket.

The term "fixedly connected" may be understood as "being adjoined". Fixedly connected may for instance comprise being connected via one or more additional structures, e.g. via one or more interface structures and/or via a capping piece fixed to or forming part of a base microfluidic piece.

The base well structure piece and the base microfluidic piece may for instance be fixedly connected to each other using one or more attachment elements, such as screws, and/or by being clamped by a clamping structure.

An advantage of having the base well structure piece and the base microfluidic piece fixedly connected to each other may be that the microfluidic device may be handled as a single piece by a user.

The microfluidic device may comprise one or more interface structures configured for coupling the plurality of microfluidic units, such as the base microfluidic piece or a structure comprising or coupled to the base microfluidic piece, to the plurality of groups of wells, such as the base well structure piece. Such one or more interface structures may provide an air and liquid tight coupling between each of the respective wells and the corresponding inlets/outlets of the corresponding microfluidic units.

The one or more interface structures may form part of the plurality of microfluidic units or the plurality of groups of wells, such as the base well structure piece.

The one or more interface structures may be provided in form of a gasket, such as a flat sheet of an elastomeric material. The gasket may have coupling perforations, e.g. of diameter 0.2 to 1 mm, for provision of fluid connections. There may be one coupling perforation for each fluid connection between a well and a corresponding inlet/outlet of the corresponding microfluidic unit.

For instance, in case of 4 wells for each group of wells and 8 microfluidic units, and thus also 8 groups of wells, there may be 4×8 coupling perforations.

The one or more interface structures may be overmoulded, e.g. onto a structure comprising or forming part of the plurality of groups of wells, such as the base well structure piece. This may facilitate assembly of the cartridge.

The one or more interface structures may be made of an elastomeric material, which may be desired to be resistant to the chemicals and reagents applied to the device such as to the wells of the device with the purpose of producing droplets e.g. oils and buffers. The elastomeric material may for instance be or comprise any one or more of: natural rubber, silicone, ethylene propylene diene monomer styrenic block copolymers, olefinic copolymers, thermoplastic vulcanizates, thermoplastic urethanes, copolyesters, or copolyamides.

The one or more interface structures may be provided with one or more attachment perforations for enabling attachment elements, such as screws, to pass through the gasket. Such one or more attachment perforation may be of 1 to 8 mm such as 6 mm in diameter.

It has been observed by the inventors that droplets tend to get a cross-sectional area at the droplet center, i.e. the inner droplet, of slightly more than the cross-sectional area of the first transfer conduit part, which is provided after the first fluid junction in the intended direction of flow. This may be because the droplet is elongated while being subject to a flow in the respective conduit. Likewise, it has been observed by the inventors that droplets tend to get a cross-sectional area, i.e. the inner droplet plus the outer shell, of slightly more than the cross-sectional area of the first collection conduit part, which is provided after the second fluid junction in the intended direction of flow.

To get smaller droplets than this, a jet stream may be required, which requires a lot of the second fluid and/or the third fluid, respectively, which may be undesired. It may be advantageously, to provide a device and a method having a low requirement for amounts of buffers and oils.

Accordingly, the cross-sectional areas defined perpendicular to the intended direction of flow of the first transfer conduit part and the first collection conduit part, respectively, may be of relevance. Each may be desired to be slightly smaller in cross-sectional area than the desired cross-sectional areas of the respective droplets, i.e. inner droplet and inner plus outer droplet, as defined through their respective droplet center.

The first transfer conduit part and the first collection conduit part of each microfluidic unit may be configured to retain their respective affinity for water for at least one month of storage from time of provision of the respective parts.

A respective affinity for water may be considered as retained if the respective contact angle hereof remains within the limit-value defined in the present disclosure for the respective affinity for water.

A respective affinity for water may be considered as retained if the respective contact angle hereof does not change from below a lower limit to above a higher limit, or vice versa. The lower limit and the higher limit may be equal, such as 60°. The lower limit may for instance be 55° or 50°. The upper limit may for instance be 65° or 70°.

The storage conditions may be 18° C. to 30° C., 0.69 atm to 1.1 atm.

The first transfer conduit part may e.g. be configured to retain the first affinity for water by being provided of a base material produced from polymers such as any one or combination of PMMA (Poly(methyl methacrylate)), Polycarbonate, Polydimethylsiloxane (PDMS), COC Cyclic Olefin Copolymer (COC) e.g. including also TOPAS, COP Cyclo-olefin polymers (COP) including ZEONOR®, Polystyrene (PS), polyethylene, polypropylene, and negative photoresist SU-8.

The first transfer conduit part may e.g. be configured to retain the first affinity for water by being provided of a material such as glass or polymers treated using a method to make the surface hydrophobic such as using siliconization, silanization, or coating with amorphous fluoropolymers.

The first transfer conduit part may e.g. be configured to retain the first affinity for water by being provided of a base material coated by applying a layer of Aquapel, sol-gel coating, or by deposition of thin films of gaseous coating material.

The first collection conduit part may e.g. be configured to retain the second affinity for water by being provided of materials including glass, silicon, or other materials providing hydrophilic properties.

The first collection conduit part may e.g. be configured to retain the second affinity for water by being provided of a base material modified using oxygen plasma treatment, UV irradiation, UV/ozone treatment, UV-grafting of polymers, Deposition of Silicon dioxide (SiO2), deposition of thin films such as Silicon dioxide by chemical vapor deposition (CVD) or PECVD.

A base material for a microfluidic device may comprise any of the following: thermoplastic, elastomers such as PDMS, thermoset, SU-8 photoresist, glass, silicon, paper, ceramic, or a hybrid of materials e.g. glass/PDMS. Thermoplastic may comprise any of the following: PMMA/acrylic, polystyrene (PS), Polycarbonate (PC), COC, COP, polyurethane (PU), poly-ethylene glycol diacrylate (PEGDA), and Teflon.

The time of provision of the respective parts may be defined as the time of provision of the coating, even if a coating is only applied to one of the first collection conduit part and the first transfer conduit part.

A high degree of stability of the surface properties of the first transfer conduit part and the first collection conduit part may enable a long shelf life of the microfluidic device.

One, more, or all parts of the microfluidic device, such as the base well structure piece and/or the base microfluidic piece, may be provided using injection moulding. Injection moulding may become more cost efficient at higher volumes, which may lead to a larger volume on stock and therefore a desire for a long shelf life.

The surface properties of the first transfer conduit part of each microfluidic unit may be provided by a coating, e.g. provided on top of a substrate. Alternatively, or in combination, the surface properties of the first collection conduit part of each microfluidic unit may be provided by a coating, e.g. provided on top of a substrate. The substrate may provide the surface properties of either the first transfer conduit part or the first collection conduit part of each microfluidic unit. The substrate may be provided in a base material such as described in the present disclosure.

Accordingly, the coating may be provided on a substrate, such that the coating constitutes either the first transfer conduit part or the first collection conduit part while the substrate constitutes the other.

The coating may be provided on a polymer by subjecting the polymer to plasma treatment followed by chemical vapour deposition, e.g. plasma enhanced chemical vapour deposition, wherein the chemical vapour deposition may comprise using $SiO_2$.

The coating may alternatively, or additionally, be provided onto a glass or polymer surface by subjecting both the first transfer conduit part and the first collection conduit part to coating such as siliconization, silanization, or coating with amorphous fluoropolymers followed by removal of the coating from the first collection conduit part e.g. using a chemical such as sodium hydroxide.

The coating may have a thickness of less than 1 μm, such than less than 500 nm, such as less than 250 nm. A thin coating may be achieved using chemical vapour deposition rather than physical vapour deposition.

An advantage of providing a thin coating may be that the diameter or cross-sectional area of the respective part of the fluid conduit network may be affected to a low degree. Accordingly, the fluid conduit network may be provided with a diameter disregarding that a coating may be applied subsequently. Accordingly, similar cross-sectional area in coated and non-coated parts may be provided.

The first transfer conduit part may be provided with stable hydrophobic surface properties. The first collection conduit part may be provided with stable hydrophilic surface properties.

The microfluidic section may comprise a base microfluidic piece providing at least a part of each of: the primary supply conduit of each microfluidic unit; the secondary supply conduit of each microfluidic unit; the tertiary supply conduit of each microfluidic unit; the transfer conduit of each microfluidic unit; the collection conduit of each microfluidic unit; the first fluid junction of each microfluidic unit; and the second fluid junction of each microfluidic unit.

The base microfluidic piece may be provided in a base material having surface properties corresponding to the first affinity for water, wherein at least a part of the coating providing the first collection conduit part is provided on top of the base material of the base microfluidic piece. Alternatively, the base microfluidic piece may be provided in a base material having surface properties corresponding to the second affinity for water, wherein at least a part of the coating providing the first transfer conduit part is provided on top of the base material of the base microfluidic piece.

The base microfluidic piece may provide at least a part of each of: the primary supply conduit of each microfluidic unit; the secondary supply conduit of each microfluidic unit; the tertiary supply conduit of each microfluidic unit; the transfer conduit of each microfluidic unit; the collection conduit of each microfluidic unit; the first fluid junction of each microfluidic unit; and the second fluid junction of each microfluidic unit.

The base microfluidic piece may be provided in a base material having surface properties corresponding to the first affinity for water.

The coating may be provided on the base material of the base microfluidic piece at the area providing at least a part of the first collection conduit part. The coating may provide a surface exhibiting the second affinity for water.

The base microfluidic piece may be provided in a base material having surface properties corresponding to the second affinity for water.

The coating may be provided on the base material of the base microfluidic piece at the area providing at least a part of the first transfer conduit part. The coating may provide a surface exhibiting the first affinity for water.

Different materials may be used for the well section and the microfluidic section. Accordingly, optimal materials for both the larger and deeper features of the well section and the very fine features of the microfluidic section may be provided. Provision of two or more parts may lower production cost as the tools for the base well structure piece and the microfluidics section may have different tolerances.

Different materials may be used for the well section and the microfluidic section. Use of different materials, for the well section and the microfluidic section may enable use of different desired materials for the respective parts.

The well section may comprise relative large and deep features while the microfluidic section may comprise very fine features.

Provision of the well section and the microfluidic section in different structures, which may be fixedly connected subsequently, may lower production cost as the tools needed for provision of the well section and the microfluidics section may have different tolerances.

The microfluidic section may e.g. be made from glass or polymer material.

Examples of polymer materials, which may be used for the microfluidic section may comprise any of the following: poly(methyl methacrylate) (PMMA), cyclic olefin copolymer (COC), cyclic olefin polymer (COP), polystyrene, polyethylene, polypropylene, polyethylene terephthalate (PET), polycarbonate (PC), polytetrafluoroethylene (PTFE). The use of polymers may be limited by their properties to be compatible with the sample, oil, and continuous phase buffer in use with the present invention, e.g. including NOVEC oil. Furthermore, use of polymers may be limited by the applicable prior art manufacturing and patterning techniques. COPs and COCs over for example PDMS may have the advantages that they have excellent transparency, near zero birefringence, low density, low water uptake, good chemical resistance, low binding of proteins, halogen-free, BPA-free, and are suited to standard polymer processing techniques such as single and twin-screw extrusion, injection moulding, injection blow moulding and stretch blow moulding (ISBM), compression moulding, extrusion coating, biaxial orientation, thermoforming and many others. COC and COP are noted for high dimensional stability with little change seen after processing. COC may in some applications be preferred over COP. COP may tend to crack if exposed to oil, such as oil which may be intended for use with the present invention. COP may crack when exposed to fluorocarbon oil such as NOVEC oil. COP may be compatible with reagents for PCR such as enzymes and DNA. COC and COP have glass transition temperatures which are typically in the range of 120-130° C. This may render them unsuitable for typical CVD coating as CVD processes are typically operated at above 300° C. and would therefore melt the COC or COP materials. This disadvantage of COC and COP may have been overcome in the present invention e.g. by applying a modified PECVD procedure operating at 85° C. COC are possibly not compatible with laser cutting as the laser may cause "burning" of the material. This disadvantage has been overcome according to the present invention e.g. using injection moulding.

Glass may alternatively, or additionally, be used as substrate with desired coating as explained for the microfluidic section.

Polydimethylsiloxane (PDMS) is often utilized for microfluidic parts. However, the inventors of the present invention have associated the following disadvantages of using PDMS:

- Change of material properties over the time (source: http://www.elveflow.com/microfluidic-tutorials/cell-biology-imaging-reviews-and-tutorials/microfluidic-for-cell-biology/pdms-in-biology-researches-a-critical-review-on-pdms-lithography-for-biological-studies/)
- Long process time (curing time of PDMS: 30 min to several hours, depending on the temperature, material stiffness required. (source Becker 2008)
- High manufacturing cost (source: Berthier, E., E. W. K. Young, et al. (2012). "Engineers are from PDMS-land, Biologists are from Polystyrenia." Lab on a Chip 12(7): 1224-1237.)
- Cost per device remains the same, even for higher volumes of production, (source: Becker, H. and C. Gartner (2008). "Polymer microfabrication technologies for microfluidic systems." Analytical and Bioanalytical Chemistry 390(1): 89-111. AND Berthier, E., E. W. K. Young, et al. (2012). "Engineers are from PDMS-land, Biologists are from Polystyrenia." Lab on a Chip 12(7): 1224-1237.)
- PDMS might absorb some molecules (e.g. proteins) at the surface. (source: Berthier 2012 AND http://www.elveflow.com/microfluidic-tutorials/cell-biology-imaging-reviews-and-tutorials/microfluidic-for-cell-biolocw/pdms-in-biology-researches-a-critical-review-on-pdms-lithography-for-biological-studies/)
- PDMS is permeable for water vapour, which lead to evaporation in the conduit. (source: http://www.elveflow.com/microfluidic-tutorials/cell-biology-imaging-reviews-and-tutorials/microfluidic-for-cell-biology/pdms-in-biology-researches-a-critical-review-on-pdms-lithography-for-biological-studies/)
- PDMS is deformable. So, the shape of the fluid conduit network might change/deform under pressure, i.e. under operation of the device (source Berthier 2012)
- Risk of leaching of non-cross linked monomers into the conduits (source Berthier 2012 AND http://www.elveflow.com/nnicrofluidic-tutorials/cell-biology-imaging-reviews-and-tutorials/nnicrofluidic-for-cell-biology/pdms-in-biology-researches-a-critical-review-on-pdms-lithography-for-biological-studies/)

Any opening of the first plurality of openings of the first fluid junction of each microfluidic unit may have a cross-sectional area being smaller than 2500 $\mu m^2$. For each microfluidic unit, the cross-sectional area of any opening between any supply conduit and the first fluid junction may be smaller than 2500 μm2. An advantage hereof may be that droplets provided by the device according to the present invention may be small enough for fluorescence-activated cell sorting (FACS).

The first transfer opening of each microfluidic unit may have a cross-sectional area being smaller than 2500 $\mu m^2$. For each microfluidic unit, the cross-sectional area of an opening between the first fluid junction and the transfer conduit may be smaller than 2500 $\mu m^2$. An advantage hereof may be that droplets provided by the device according to the present invention may be small enough for fluorescence-activated cell sorting (FACS).

The first transfer opening of each microfluidic unit may have a cross-sectional area being between 50% and 100% of the cross-sectional area of the second transfer opening of the corresponding microfluidic unit. For each microfluidic unit, the cross-sectional area of an opening between the first fluid junction and the transfer conduit may be between 50% and 100% of the cross-sectional area of an opening between the second fluid junction and the collection conduit. An advantage hereof may be that droplets provided by the device according to the present invention may have a shell thickness resulting in stable droplets that are not too large for FACS.

If the cross-sectional area of the opening leading out of the second junction is smaller than or equal to the cross-sectional area of the opening leading out of the first junction, droplet production may become unstable. If it is a too much larger than the first junction, the oil shell may become thicker than desired.

The microfluidic section may comprise a first planar surface, which may be provided by the base microfluidic piece, and a capping piece comprising a second planar surface. The first planar surface may have a plurality of ramified recesses providing a base part of each fluid conduit network of the microfluidic device. The second planar surface may face the first planar surface. The second planar surface may provide a capping part of each fluid conduit network of the microfluidic device. The capping piece may comprise a third planar surface facing the well section.

The base microfluidic piece may be provided with a first planar surface having a plurality of ramified recesses providing a base part of each of the fluid conduit networks of the microfluidic device. The microfluidic device may furthermore comprise a capping piece having a second planar surface facing the first planar surface of the base microfluidic piece. The second planar surface of the capping piece may provide a capping part of each of the fluid conduit networks of the microfluidic device. The capping piece may have a third planar surface facing the base well structure piece.

The base microfluidic piece may be provided by a base substrate. The capping piece may be provided by a capping substrate.

One, more, or all parts of each fluid conduit network may form an acute trapezoidal cross section, wherein the longer base edge may be provided by the second planar surface of the capping piece A cross section of the fluid conduit network may vary throughout the network. It may be rectangular, square, trapezoidal, oval or any shape suitable to the droplet formation. In some examples, a conduit may have four walls with two of the walls provided in parallel or coplanar to each other. An acute trapezoidal cross section, such as wherein the longer base edge is formed by a cover section, may have the advantage that deposition of coating may be more even on the walls and bottom of a conduit as compared e.g. to a square, rectangular or oval shape. A higher draft angle of the conduit wall may result in a more even layer of coating than a lower draft angle and/or may facilitate ejection of the conduit structure from a mould without changing the dimensions of the conduits. The conduit walls may have a draft angle of 5-45 degrees, such as 10-30 degrees.

The acute trapezoidal cross section may form an isosceles trapezoidal cross section, wherein the side walls of equal length may have a tapering of at least 5 degrees and at most 20 degrees with respect to a normal of either of the parallel base edges. This may also be denoted "draft angle". An advantage hereof may be that it may be easier to apply a coating to the base microfluidic piece such that a desired thickness is applied to a bottom part as well as side parts. Furthermore, if the base microfluidic piece is provided by means of moulding, such as injection moulding, it may be easier to extract the base microfluidic piece from the mould during manufacture of the microfluidic device.

A typical result of an injection moulding sharp corners in the bottom with a tapering of 5-20 degrees. The upper part of the walls, towards the capping piece, may be rounded, but this may still provide a tapering of more than five degrees. Milled conduits would in most cases not be tapered whereas conduits edged in glass may have round corners at the bottom, such as like the bottom of a U.

Each microfluidic unit may comprise a primary filter at or within the primary supply conduit. Each microfluidic unit may comprise a secondary filter at or within the secondary supply conduit. Each microfluidic unit may comprise a tertiary filter at or within the tertiary supply conduit.

Any one, more or all of: the primary filter, the secondary filter, and the tertiary filter may be denoted "filter".

Each or any filter may comprise a structure that obstructs passage of particles having a dimension higher than a filter threshold value. The filter threshold value may for instance be the volume of the smallest of first and the second fluid junction and/or the smallest diameter or cross-sectional area of the fluid conduit network. A filter may provide a network of flow lines/conduits smaller than filter threshold value. A filter may for instance be provided by a plurality of pillars.

Each or any filter may be provided as a plurality of rows of a plurality of pillars with the height equal to the conduit depth at the pillars, a diameter between 5 and 16 μm, and a pitch, i.e. distance between the centre of each pillar, of 15 to 100 μm. The pillars may be in form of cylinders, i.e. with a constant diameter throughout the height or be tapered towards the top of the conduit, i.e. with a diameter larger at the bottom of the pillar compared to the diameter at the top of the pillar. Pillar filters have the advantage of trapping particles of many different sizes, while affecting the conduit resistance only to a minimum.

Each or any filter may comprise a weir. Thereby the height of the conduit in the area comprising the filter may be reduced, and thereby block any particles larger than the height of the conduit at the position of the weir from entering the remaining part of the microfluidic unit.

The first transfer conduit part may have an extension of at least 200 μm, such as at least 500 μm, such as at least 1 mm. The first transfer conduit part may have an extension of 3 mm at most.

The extension of the first transfer conduit part may be equal to or smaller than the length of the transfer conduit.

The desired extension of the first transfer conduit part may be a compromise of a plurality of aspects as explained in the following.

The shorter the conduit, the lower the resistance. A low resistance may be desired. The longer the first transfer conduit part, the easier it may be to align when bonding since variability in alignment of coating and alignment of lower and upper microfluidic part, such as the base the base microfluidic piece and the capping piece, may be mitigated. Furthermore, the bonding may be stronger if the first transfer conduit part is long.

Accordingly, the desired length of the first transfer conduit may be regarded because of a compromise of different aspects.

The depth and/or width and/or cross-sectional area may vary along one or more parts of the fluid conduit network. The transfer conduit may for instance have a wider portion between the first transfer conduit part and the second fluid junction. This may be to reduce the resistance and/or increase the flow rate in some areas of the chip.

The largest area of a cross-section of the transfer conduit may be less than 10 times the smallest area of a cross-section of the transfer conduit such as less than 5 times or less than 2 times. If the transfer conduit is too large compared to the opening between the first fluid junction and the transfer conduit, the droplets loose alignment and may not arrive at the second junction at equal intervals or with equal spacing which may result in non-homogenous oil shell thickness and/or droplet size. The depth of each fluid conduit network may be the same throughout the microfluidic section. This may be to facilitate production e.g. of moulds, etching, and/or other means of producing the microfluidic section.

The depth of a fluid conduit network may vary. This may e.g. be to decrease resistance in parts of the microfluidics section. The narrowest section of the primary supply conduit may have a cross-sectional area of 10-5000 $\mu m^2$, such as 50-500 $\mu m^2$, such as 150-300 $\mu m^2$. A narrow section of a conduit may be cylindrical, or it may be in the form of a nozzle. The primary supply conduit may be defined to end where the sample comes into fluid contact with the oil from the secondary supply conduit.

The narrowest section of the secondary supply conduit may have a cross sectional area of 10-5000 $\mu m^2$, such as 50-500 $\mu m^2$, such as 150-300 $\mu m^2$. The secondary supply conduit, such as comprising the first secondary supply conduit and the second secondary supply conduit, may be defined to end where the oil comes into fluid contact with the sample from the primary supply conduit. The aspect ratio of average width to average depth of a conduit at any position in the chip may be less than 5:1, such as less than 3:1, such as less than 2:1. Production may be facilitated by provision of conduits being wider than they are deep.

The narrowest section of the tertiary supply conduit may have a cross sectional area of 10-5000 $\mu m^2$, such as 50-500 $\mu m^2$, such as 150-300 $\mu m^2$. The tertiary supply conduit, such as including the first tertiary supply conduit and the second tertiary supply conduit, may be defined to end where the buffer comes into fluid contact with the carrier phase, e.g. oil, from the transfer conduit.

The narrowest section of the transfer conduit may have a cross sectional area of 10-5000 $\mu m^2$, such as 50-500 $\mu m^2$, such as 150-300 $\mu m^2$.

The narrowest section of the collection conduit may have a cross-sectional area which is 5-80% larger than the narrowest section of the primary supply conduit, such as 10-50% larger, such as 15-30% larger. The narrowest section of the collection conduit may have a cross-sectional area, which is 10-5000 $\mu m^2$, such as 50-1000 $\mu m^2$, such as 200-400 $\mu m^2$. This may facilitate that the droplets generated have an inner diameter of 10 to 25 μm and an outer diameter of 18 to 30 μm, which may facilitate use of standard equipment designed for bacterial or human cells for subsequent processing, quantification, handling, or analysis of the droplets. The inner diameter may be understood as the diameter of the inner droplet, e.g. of the first fluid, e.g. sample. The outer diameter may be the outer diameter of the shell of the second fluid, e.g. oil.

The relative small size of droplets generated with the present system may facilitate analysis, quantification and processing using instruments designed for use with cells. If a DE droplet, i.e. e.g. the combination of the oil layer and the aqueous inner phase, are sufficiently small, such as smaller than 40 μm or smaller than 25 μm, then a collection of double emulsion droplets may be analysed and processed using equipment developed for bacterial or mammalian cells such as flow cytometers and cell sorters.

The cross-sectional area of the first transfer conduit may affect the resistance. The smaller the cross-sectional area, the higher the resistance may be.

The cross-sectional area of any supply conduit may have a minimal cross-sectional area being larger than any opening, or the average openings, of the corresponding filter, also denoted filter rating or filter size. This may be to alleviate blocking of the conduit by particles in the filter.

It may be desired that the opening between a supply conduit and a corresponding fluid junction, such as between the first fluid junction and the secondary supply conduit, has a specified cross-sectional area range or value. Furthermore, it may be desired that a supply conduit has the same cross-sectional area at an adjacent part thereof leading up to the respective fluid junction as cross-sectional area of the opening into the respective fluid junction. Such adjacent part may for instance be at least 50 μm. However, to facilitate an overall lower resistance in the respective conduit, the remaining part of the respective supply conduit, or at least a major part thereof, may have a higher cross-sectional area.

The cross-sectional area of the transfer conduit may be smaller than the cross-sectional area of the supply conduits. A large cross-sectional area of the transfer conduit may disturb the periodic flow of the droplet within the conduit. The transfer conduit may be void of any section, wherein the cross-sectional area is larger than twice the cross-sectional area of the first transfer opening.

The cross-sectional area of the collection conduit may be larger than the second transfer opening. This may be to decrease resistance in the conduit.

The first collection conduit part may comprise the region from the center of the second fluid junction to 250 μm from the center of the first fluid junction or at least the region from 25 μm to 75 μm from the center of the first fluid junction in the intended direction of the fluid flow corresponding to the area where droplets or plug formation occurs.

The distance between the first and second fluid junction, which may correspond to the length of the transfer conduit, may be at least 200 μm, such as at least 500 μm, 1000 μm or 1500 μm. A longer distance may facilitate large scale production of microfluidic device. Variation in placement of coating and placement/alignment of e.g. the base microfluidic piece and the capping piece may be expected. For facilitating that the first transfer conduit part and the first collection conduit part have correct surface properties, it may be desired to have a sufficient distance between the two junctions. A larger distance between the first junction and second junction may reduce the risk of insufficient bonding/attachment between the base microfluidic piece and the capping piece adjacent to the secondary supply conduit, the tertiary supply conduit, and the transfer conduit, which may be critical bonding area.

A kit according to the present invention may include aqueous liquids, reagents, buffers, oils necessary, cartridges, chips, gaskets sufficient to generate double emulsion droplets and instructions for using kit components with the instrument. Aqueous liquids suitable for the inner aqueous phase of the droplets may include PCR reagents such as dNTPs, one or more polymerases, and salts. Aqueous liquids suitable for the outer carrier phase may have essentially the same osmolarity as the aqueous liquid suitable for the inner aqueous phase of the droplets. The aqueous liquids may include emulsion stabilizing agents such as polyether compounds and co-emulsifiers. The aqueous liquids may additionally comprise thickening agents.

If the carrier phase, i.e. the fluid provided by the tertiary supply well, of the droplets generated according to the present system is aqueous, then analysis and processing using standard instruments designed for use with cells, such as bacterial or mammalian cells, may be facilitated.

The sample buffer may be denoted the first fluid. The first fluid may comprise the sample buffer. The oil may be denoted the second fluid. The second fluid may comprise the oil. The continuous phase buffer, which may be referred to as the buffer, may be denoted the third fluid. The third fluid may comprise the buffer.

The enzyme may be provided in the sample buffer or separate from the sample buffer. An advantage of separate provision may be that the enzyme may be stored under different conditions, such as high glycerol concentrations, which may increase stability. An advantage of provision in sample buffer may be to facilitate use by simplifying pipetting steps and decreasing risk of errors.

The nucleotides may be provided in the sample buffer or separate from the sample buffer. An advantage of separate provision may be that the dNTP may be stored under different conditions, such as at higher concentrations, which may increase stability. An advantage of provision in sample buffer may be to facilitate use by simplifying pipetting steps and decreasing risk of errors.

The sample buffer may be of essentially the same osmolarity and/or comprise essentially the same concentrations of ions as the continuous phase buffer. Provision of such features may be advantageous since the concentrations of the components of the sample may otherwise change due to osmosis through the oil membrane. Changes in the concentration of sample or buffer components may lead to decreased efficiency of reactions performed in the droplets in subsequent steps. Swelling of the droplets due to osmosis may lead to droplets becoming too large for handling e.g. in a cell sorter. Examples of sample buffers may comprise ions such as $Na^+$, $Ka^+$, $Ca^{++}$, $Mg^{++}$, $NH_4^+$, $SO4^{--}$ and $Cl^-$, buffering compounds such as Tris-HCl, glycerol, Tween, nucleotides, and enzymes. A corresponding continuous phase buffer may comprise essentially the same concentrations of $Ka^+$, $Ca^{++}$, $Mg^{++}$, and $Cl^-$, glycerol and buffering compounds such as Tris-HCl as the sample buffer, but possibly not nucleotides or enzymes as the reaction occurs within the droplets.

An example of a suitable sample buffer is a buffer comprising 10 mM Tris-HCl, 57 mM Trizma-base, 16 mM $(NH_4)_2SO_4$, 0.01% Tween 80, 30 mM NaCl, 2 mM $MgCl_2$, 3% glycerol, and 25 μg/μL BSA. An example of a corresponding, suitable continuous phase buffer is a buffer comprising or consisting of 20 mM Tris-HCl (pH 9), 57 mM Trizma-base, 16 mM $(NH_4)_2SO_4$, 0.11% Tween 80, 30 mM NaCl, 2 mM $MgCl_2$, 3% glycerol, 1% PEG 35K, and 4% Tween 20.

Another example of a suitable sample buffer is a buffer comprising or consisting of 10 mM Tris-HCl, 57 mM Trizma-base, 16 mM $(NH_4)_2SO_4$, 0.01% Tween 80, 30 mM NaCl, 2 mM $MgCl_2$, 3% glycerol, and 25 μg/μL BSA, 0.2 mM dNTP, 0.2 μL primers, and 2 units Taq DNA polymerase. An example of a corresponding, suitable continuous phase buffer is a buffer comprising or consisting of 20 mM Tris-HCl (pH 9), 57 mM Trizma-base, 16 mM $(NH_4)_2SO_4$, 0.11% Tween 80, 30 mM NaCl, 3% glycerol, 1% PEG 35K, and 4% Tween 20.

The buffers may be provided two-fold concentrated, 10-fold concentrated or other concentrations. During use, the buffer may then be provided by dilution of the concentrated buffer to achieve a desired concentration, such as the concentrations in the above examples, before being loaded into the respective wells of the microfluidic device.

The density of the oil may be higher than the density of the continuous phase buffer. This may be to enable the droplets to sediment in the continuous phase buffer. This, in turn, may facilitate the collection of droplet from the bottom of the collection well. The density of the oil being higher than the density of the continuous phase buffer may prevent oil from evaporating at increased temperature, such as applied during PCR cycling. Another advantage of the density of the oil being higher than the density of the continuous phase buffer may be that if processing the droplets in a flow cytometer of cell sorter or other equipment for handling cells, the droplets may sediment like cells, which may facilitate handling.

An advantage of the present invention, such as the kit comprising an oil, wherein the oil has a density higher than the density of the sample buffer, may comprise that the resulting droplets may sediment in the collection well, e.g. in case the collection well is provided with a suitable recess, which in turn may facilitate collection of droplets from the collection well. The droplets sedimenting in the continuous phase buffer may additionally, or alternatively, result in droplets that are protected from evaporation by an upper layer of continuous phase buffer which in turn may increase droplet stability in reactions such as PCR reactions.

The method for providing double emulsion droplets may comprise use of the microfluidic device according to the present invention.

The method for providing double emulsion droplets may comprise use of the microfluidic device according to the present invention. The method may comprise: providing a first fluid to the primary supply well of a first group of wells; providing, possibly subsequently, a second fluid to the supply well of the first group of wells, which supply well is in fluid communication with the secondary supply conduit of the corresponding microfluidic unit, such as the primary supply well; providing a third fluid to the tertiary supply well of the first group of wells; and providing individual pressure differences between each of the respective supply wells of the first group of wells and the collection well of the first group of wells, such that the pressure within each of the individual supply wells of the first group of wells is higher than within the collection well of the first group of wells.

The method for providing double emulsion droplets may comprise: providing a primary flow of a first fluid from the primary supply well to the first fluid junction via: the primary supply inlet, the primary supply conduit, and the primary supply opening; and providing a secondary flow of a second fluid from the one supply well of the plurality of supply wells being in fluid communication with the secondary supply inlet of the corresponding microfluidic unit to the first fluid junction via: the secondary supply inlet, the secondary supply conduit, and the secondary supply opening; wherein the primary flow and the secondary flow provides a transfer flow of the first fluid and the second fluid from the first fluid junction to the second fluid junction via: the first transfer opening, the transfer conduit, and the second transfer opening.

The method for providing double emulsion droplets may comprise: providing a tertiary flow of a third fluid from the tertiary supply well to the second fluid junction via: the tertiary supply inlet, the tertiary supply conduit, and the tertiary supply opening; wherein tertiary flow and the transfer flow provides a collection flow of the first fluid, the second fluid, and the tertiary fluid, to the collection well via: the collection opening, the collection conduit, and the collection outlet.

The method for manufacturing a microfluidic device according to the present invention may comprise: changing surface property of a part of each of two parts of the microfluidic section; and joining the two parts of the microfluidic section by thermal bonding and/or clamping. The first part may be the base microfluidic piece and the second part is the capping piece of the microfluidic section. The method may comprise: manufacturing the first part in one piece; partially coating the areas of the first part and the second part corresponding to the first transfer conduit part or the first collection conduit part; and joining the two parts.

Surface modification of the microfluidic section may be necessary to achieve specific surface properties on the walls of the conduits. The surface modification may prevent adsorption of proteins such as enzymes, nucleotides, or ions onto the walls of the conduits or help to control the flow of hydrophobic or hydrophilic liquids.

Provision of the droplets may be realized in two steps. A water in oil droplet may be generated at the first fluid junction, requiring a hydrophobic surface in the area/conduit following the first fluid junction. An oil in water droplet, which oil part may contain water, may be formed at the second fluid junction, requiring a hydrophilic surface at this point in the area/conduit following the second fluid junction. Therefore, spatially-controlled modification of the surface of the conduit may be required. Alternatively, different materials in the different areas may be used, so that the inherent properties of the materials give the required surface properties at all positions of the fluid conduit network.

Different techniques may be used for the surface modification on a local part of the fluid conduit network. The method of choice may depend on the required stability of the surface modification, the material to modify, the compatibility of the surface modification with the chemicals in use and the configuration of the microchip when doing the surface modification. It may be desired to modify the entire circumference of a conduit, e.g. all four walls. An important criterion for the choice of surface modification method may be the effect on the material, as the method of surface modification should not damage the material or increase its roughness.

Polymer materials are in general hydrophobic, which may be defined by having a contact angle larger than 90°. Different techniques exist to change the surface from hydrophobic to hydrophilic, such as the deposition of chemicals, e.g. polymers, onto the surface or the modification of the surface itself, e.g. via exposure to plasma.

Surfaces of the conduits may be exposed to plasma, e.g. oxygen or air plasma for an appropriate amount of time, e.g. 1; 2; 5; 10 or more minutes. Reactive species/radical will come in contact with the surface and thereby the surface will become hydrophilic. Open reactive sites on the surface which may be used for grafting of further molecules.

A disadvantage of this process may be that surfaces will revert to their inherent hydrophobic properties with time. This means that treated devices may need to be used soon after surface modification.

A Hydrophobic surface may alternatively, or additionally, be exposed to UV light for an appropriate amount of time to obtain a hydrophilic surface. For example, Subedi, D. P.; Tyata, R. B:; Rimal, D.; Effect of UV-treatment on the wettability of polycarbonate. Kathmandu University Journal of science, engineering and technology, Vol 5, No II, 2009, pp 37-41, have shown to treat polycarbonate with UV light for 25 min and obtain a decrease of the contact angle from 82° to 67°.

To achieve a more stable surface modification, i.e. a modification of the surface which lasts for an extended period, thereby providing an improved, i.e. a longer, shelf life of the devices, it may be desired to attach permanently molecules onto the surface, which attachment will make the surface hydrophilic.

UV-grafting to polymers may involve several steps, where for example a photoinitiator such as benzophenone is first deposited onto the surface and then the coating polymer is added. This may then be followed by illumination with UV-light where the polymer covalently binds to the surface (Kjaer Unmack Larsen, E. and N. B. Larsen (2013). "One-step polymer surface modification for minimizing drug, protein, and DNA adsorption in microanalytical systems." Lab on a Chip 13(4): 669-675.).

In some examples, the UV-grafting of chemicals may be combined with a surface pre-treatment, e.g. with plasma oxidation.

Thin film may be deposited onto a substrate using physical vapor deposition (PVD), e.g. as described in https://www.memsnet.org/mems/processes/deposition.html. In this technique, the material to be deposited may be released from a target and directed onto the substrate to coat. Sputtering and evaporation are two techniques to release material from a target.

The advantage of sputtering over evaporation may be the low temperature at which the material may be released from the target. In sputtering, the target and substrate are placed in a vacuum chamber. Plasma may be induced between two electrodes. This ionizes the gas. Target material may be released in vapor form by the ionized ions of the gas and deposits on all surfaces of the chamber, among others the substrate.

Sputtering may be used to deposit thin films of chromium oxide onto polymers which makes their surface hydrophilic.

In contrast to PVD, thin films are deposited by chemical vapor deposition (CVD) due to a chemical reaction happening between different source gases. The product may then deposit onto all the walls of the chamber as well as the substrate. Different technologies are available for CVD. For example, plasma-enhanced CVD (PECVD) uses plasma to ionize gas molecules before the chemical reaction. PECVD uses lower temperatures than other CVD technologies, which represents a major advantage when coating a substrate not resistant to high temperatures. PECVD is widely used for the deposition of thin films in semiconductor applications. Materials that may be deposited are among others silicon dioxide ($SiO_2$) and silicon nitride (SixNy). Plasma Enhanced Chemical Vapor Deposition (PECVD) is described in e.g. http://www.plasma-therm.com/pecvd.html.

Liquid coating may be deposited onto a flat surface using spin coating. In spin coating, liquid material may be placed onto the middle of a substrate. During spinning, the liquid coating spreads uniformly onto the complete surface of the substrate. Different parameters such as rotation speed or time are responsible for the thickness of the deposited film.

This technique is commonly used for example for the deposition of photoresist onto wafers.

Yet another technique to deposit a coating onto a substrate is via spraying, where a stream comprising small droplets of liquid material may be directed onto the substrate. When sprayed onto a substrate comprising an open conduit, liquid coating may be allowed to dry before the capping piece or ceiling of the conduit is added. If applied accurately, spraying and drying of a liquid coating material onto the substrate may avoid masking of the substrate and the process may be more cost effective for large scale production.

Corona treatment, e.g. as described in http://www.vetaphone.com/technology/corona-treatment/, is a technique where a plasma may be generated at the tip of an electrode. This plasma modifies the polymer chains at the surface of the substrate, thereby increasing the surface energy and hence the wettability of the material.

Without further treatment, the substrate will revert to its inherent properties.

Another technique to make polymer surfaces hydrophilic is the UV/ozone treatment. This technique is typically used for the cleaning of surfaces from organic residues. Under UV/ozone treatment, the surfaces are photooxidized by UV-light and atomic oxygen and the surface molecules are modified (A. Evren Özçam, Kirill Efimenko, Jan Genzer, Effect of ultraviolet/ozone treatment on the surface and bulk properties of poly(dimethyl siloxane) and poly(vinylmethyl siloxane) networks, In Polymer, Volume 55, Issue 14, 2014, Pages 3107-3119). The UV/ozone treatment causes less damage to the surface than other treatment such as plasma treatment.

Microfluidic chips may be made out of glass. The surface of glass is hydrophilic and water spreads on the surface. For the present invention, in the case of microfluidic conduits made of glass, the surface at the first transfer conduit part or the first collection conduit part has to be modified from hydrophilic to hydrophobic. Glass surfaces may be modified for example with silanes to obtain permanent modification of the surface. As described in https://www.pcimag.com/ext/resources/PCI/Home/Files/PDFs/Virtual_Supplier_Brochures/Gelest_Additives.pdf, different types of silanes exist that may lead to hydrophobic properties.

Modifying surface properties of the fluid conduit network at a predefined area, e.g. from hydrophobic to hydrophilic, may be realized before assembly of a substrate comprising the base microfluidic piece with a substrate comprising the capping piece.

A physical mask such as a metal or glass plate, a polymer sheet or any appropriate material, may be used to protect the areas that should not be exposed to the coating/surface modification treatment. The mask may be attached/brought in contact with the surface in any suitable way, such as be a hard or soft contact mask. The mask may also go into any of the ramified recesses to prevent coating material from leaking under the mask. The mask may be any material that may be used only once, e.g. in the case of a mask that is damaged/destroyed when removed from the surface, or reused a plurality of times.

This strategy may be used for methods involving a coating deposited in gas form or a physical treatment such as UV-exposure or a liquid coating deposited via sputtering or spray onto the surface.

After removal of the mask, a partially patterned conduit may be obtained.

For modifying all, such as four, walls of a fluid conduit, both the capping piece and the base microfluidic piece may need to be treated. Accurate alignment may be necessary to assure that the transition hydrophobic/hydrophilic will take place at the same position for all four conduit walls. Accurate alignment may not be necessary at the end, i.e. in the intended direction of flow, of the first transfer conduit part/the first collection conduit part.

An advantage of this strategy may be that a high number of devices may be treated at the same time. Moreover, the deposited coating material may be analyzed, e.g. thickness measurement, coating homogeneity after the coating process.

If the fluid conduit network is formed by the capping piece being positioned over the ramified recesses of the base microfluidic piece, i.e. is in a closed configuration, any liquid coating may be deposited very accurately in the conduit and will wet all four walls of the fluid conduit network.

To achieve a spatially controlled modification, flow confinement may be used using an inert fluid, i.e. a fluid which will not mix or interact with the liquid coating fluid.

Liquid coating material may be introduced via the tertiary supply conduit, while the rest of the fluid conduit network may be protected from exposure to the coating material using flow confinement with an inert liquid or with air, such as water or oil. While flowing in the conduit, the coating may be deposited on all walls of the fluid conduit network. This technique may require accurate flow control and does not enable measurement of the thickness of the deposited layer.

In some examples, the spatial patterning may be achieved by blocking the gaseous treatment from reaching some areas of the fluid conduit network. For example, for a closed part of the fluid conduit network, plasma oxidation may be limited by diffusion. Hence, if the diffusion may be limited in some areas of the fluid conduit network, the plasma will be denser in some areas compared to others. Therefore, some regions will be modified while others will not be affected by the plasma.

Limiting the diffusion to some areas of a closed conduit for plasma oxidation may be done in different ways, such as blocking the inlets close to the areas to protect or connecting a long conduit to the inlets close to the areas to protect, thereby increasing the resistance of the conduit which will prevent plasma from going into those regions of the microchip or any other methods This process may require an accurate spatial control of the plasma and yields a gradual transition between the hydrophobic and hydrophilic areas. Moreover, this treatment may not be stable over time as the treated regions reverse to their inherent hydrophobic properties within some hours, depending on the polymer material used.

The microfluidics section of the cartridge may be partially coated in at least a first transfer conduit part or a first collection conduit part.

The first transfer conduit part may refer to the zone immediately following the first fluid junction in the direction of the fluid flow, where formation of aqueous droplets in oil carrier fluid may occur. The first transfer conduit part may comprise the region from the center of the volume of the first fluid junction to the center of the second fluid junction or at least the region from 25 μm to 75 μm from the center of the first fluid junction in the direction of the fluid flow.

The first collection conduit part may refer to the zone immediately following the second fluid junction in the direction of the fluid flow, where formation of double emulsion aqueous droplets surrounded by an oil shell in an aqueous carrier fluid may occur. The first collection conduit part may comprise the region from the center of the volume of the second fluid junction to 250 μm from the center of the second fluid junction or at least the region from 25 μm to 75 μm from the center of the first fluid junction in the direction of the fluid flow.

The first transfer conduit part may be hydrophobic with a contact angle measured with water of at least 70°, such as 80° or 90°. If the first transfer conduit part is produced from a hydrophobic material such as a polymer, the first transfer conduit part may be uncoated. The first transfer conduit part may be treated in such a way that the contact angle is at least 70°, such as 80° or 90° after treatment.

The first collection conduit part may be hydrophilic with a contact angle measured with water of not more than 40°, such as not more than 30° or 20°. If the first transfer conduit part is produced from a hydrophilic material such as glass, the first transfer conduit part may be uncoated, i.e. the first transfer conduit part may be treated in such a way that the contact angle is not more than 40°, such as not more than 30° or 20° after treatment.

As conduit cross-sectional area may be very small in some areas, such as the junctions and filter areas of the microfluidic section, the coating may be very thin to have minimal effect on the cross-sectional area. A suitable thickness of the coating may be less than 1 μm such as less than 500 nm or less than 100 nm.

The fluidic cartridge may be made of polymer in all parts or be a hybrid between different materials such as a hybrid of different polymers or a polymer-glass hybrid. If a polymer-glass hybrid is used, the base well structure piece may be made of polymer while the microfluidic device may be made of glass.

The microfluidic cartridge may be manufactured from three or more separate parts which are subsequently assembled into a cartridge. The separate parts may include a base well structure piece, a microfluidic structure and a capping piece. The assembly of the parts may be performed using thermal bonding, heat stacking or similar techniques. An elastomer may be over-moulded onto either the base well structure piece, the microfluidic structure or both to ensure a pressure tight seal between the instrument and the cartridge and between the microfluidic structure and the base well structure piece.

The base well structure piece may be made using injection moulding. For injection moulding, a mould may be created by machining the negative shape of the base well structure piece in one or more blocks of e.g. METAL. The polymer may be melted and flows into the mould. Upon cooling, the polymer will retain the shape of the mould and will be ejected from the mould for use. The mould may be reused for a high number of parts. For injection moulding, different thermoplastics may be used such as poly(methyl methacrylate) (PMMA) or cyclic olefin copolymer (COC), or cyclic olefin polymer depending on the compatibility with the chemicals in use.

The base well structure piece may be provided using 3D printing techniques. Various 3D printing techniques are available, such as stereolithography or fused filament printing. Layers of material are deposited and cured onto each other creating the object. The base well structure piece may be 3D printed onto the microfluidics section.

Fabrication of the microfluidic device may be realized by different microfabrication methods, depending on the volume to produce, material of choice as well as the resolution required/smallest feature to pattern/create.

For low volumes, soft lithography and/or laser ablation may be used. For example, soft lithography of PDMS may alternatively, or additionally be used to fabricate the two substrates of the microfluidic device. The PDMS mixture may be poured over a mould containing the negative shape of the microstructure. After curing, the PDMS part and the mould are separated.

High precision micromachining alternatively, or additionally be used to create microstructures in a polymer substrate. However, typically the size of the microstructures cannot be below 50 μm and this technique may be time consuming.

For high production volumes, replication methods are often used including hot embossing, injection moulding among others or LIGA (German abbreviation: lithographie (Lithography), Galvanoformung (electroplating), Abformung (moulding)). Those methods involve the fabrication of a mould which contains the negative shape of the structure such as ramified recesses and possibly any additional feature on the substrate, e.g. holes for fluidic connection, alignment features, etc.

The mould may be produced using different techniques such as high precision micromachining, electrical discharge machining (EDM) or photolithography. Photolithography may be the first step for the fabrication of the mould, followed by electroplating as described here. A silicon substrate may be coated with a layer of photoresist which then may be exposed to UV-light through a chromium mask to create a positive shape of ramified recesses. Nickel may then be deposited onto the photoresist by electroplating. The silicon wafer may then be chemically dissolved, e.g. using KOH. The mould insert may be diced and inserted into the microinjection moulding tool, which forms a cavity containing the negative shape of the ramified recesses.

After fabrication of the mould, polymer may be melted and flows in the microcavities of the mould. When the polymer cools down, it retains the shape of the mould. Critical parameters such as filling pressure and/or temperature need to be optimized to achieve a good replication of the mould and a correct demoulding/removal of the microstructured parts from the mould.

Assembly of the polymer substrate containing the conduit and of the polymer capping piece substrate may be necessary to create a closed and liquid tight conduit. The assembly of the substrate or closing of the conduit may be done irreversibly using various techniques, for example through thermobonding ultrasonic or laser welding, lamination. In thermobonding, the polymer substrates are heated slightly below glass transition temperature and high pressure may be applied to assemble the two substrates. The temperature, time and pressure parameters may have to be optimized so that the microstructure is not damaged by the process. For lamination, a thin laminate, e.g. 30 μm to 400 μm thick, with an adhesive surface, e.g. pressure sensitive adhesive, may be placed over the part of the conduit. Pressure may be applied uniformly over the whole surface to seal the laminate, using for example a roller.

Another method of irreversible closing of the conduit may be used for microstructures made of PDMS. The PDMS part may be assembled with a flat PDMS part or a glass substrate. After cleaning of those parts using a solvent, e.g. ethanol and/or isopropanol, the parts may be exposed to oxygen plasma for 1 minute. The two surfaces are then brought into contact to form an irreversible bond.

One or more parts of the microfluidic device, such as including the base microfluidic piece, may be made of glass. In this case, the fluid conduit network may be made using photolithography and anisotropic etching. Inlet holes may be made using sand/powder blasting.

Similar as for microchips made of polymers, glass microchips need to be closed to create a liquid tight conduit.

Assembly of the glass substrates may be done e.g. via anodic bonding.

The microfluidic section may comprise a first transfer conduit part and a first collection conduit part. The first transfer conduit part refers to the zone immediately following the first fluid junction in the direction of the fluid flow where formation of aqueous droplets in oil carrier fluid occurs. The first transfer conduit part may comprise the region from the center of the volume of the first fluid junction to the center of the second fluid junction or at least the region from 25 μm to 75 μm from the center of the first fluid junction in the direction of the fluid flow.

The first collection conduit part refers to the zone immediately following the second fluid junction in the direction of the fluid flow where formation of double emulsion aqueous droplets surrounded by an oil shell in an aqueous carrier fluid occurs. The first collection conduit part may comprise the region from the center of the volume of the second fluid junction to 250 μm from the center of the second fluid junction or at least the region from 25 μm to 75 μm from the center of the first fluid junction in the direction of the fluid flow.

FIGS. 1-4 schematically illustrate various views of a first embodiment of a microfluidic device 100 according to the present invention. The different shadings of the sections when comparing FIGS. 3 and 4 are unintentional. For any drawings having such, the right-handed Cartesian coordinate system indicates the individual schematic views of an embodiment are oriented with respect to each other.

The microfluidic device 100 comprises a microfluidic section and a well section. The microfluidic section comprises one microfluidic unit 170. The well section comprises one group of wells 171. The number of groups of wells corresponds to the number of microfluidic units.

The well section and the microfluidic section forms a fixedly connected unit, as illustrated in FIGS. 1 and 3. The group of wells 171 forms a fixedly connected unit with the corresponding microfluidic unit 170.

Some of the following cited features of the microfluidic unit 170 are for illustrative purpose shown in FIG. 2 even though these features will not be present in the exploded version, but are present in the non-exploded version shown in FIGS. 1 and 3.

The microfluidic unit 170 comprises a fluid conduit network 135 comprising: a plurality of supply conduits 103, 106; a transfer conduit 112; and a first fluid junction 120.

The plurality of supply conduits comprises a secondary supply conduit 106 and a primary supply conduit 103. The primary supply conduit comprises a capillary structure 173 having a volume of at least 2 μL.

The secondary supply conduit 106 comprises a first secondary supply conduit 106*a* and a second secondary supply conduit 106*b* configured to exert a pinching action of the second fluid on a stream of the first fluid from the first supply conduit 103 during use.

The primary supply conduit 103 comprises a connection conduit 103*a* provided between the capillary structure 173 and the first fluid junction 120.

The first fluid junction 120 provides fluid communication between the primary supply conduit 103, the secondary supply conduit 106, and the transfer conduit 112.

The group of wells 171 comprises a plurality of wells comprising a collection well 134 and a primary supply well 131. The collection well 134 is in fluid communication with the transfer conduit 112. The primary supply well 131 is in fluid communication with the primary supply conduit 103 and the secondary supply conduit 106.

The primary supply conduit 103 provides fluid communication between the primary supply well 131 and the first fluid junction 120.

The secondary supply conduit 106 provides fluid communication between the primary supply well 131 and the first fluid junction 120.

The capillary structure 173 comprises a first capillary conduit 174 having a width defined along the x-axis of at least 2 mm, a depth defined along the z-axis of at least 0.05 mm, a longitudinal extension, may also be denoted "length", defined along the y-axis of at least 8 mm, and a cross-sectional area perpendicular to the longitudinal extension, which is also along the intended general direction of flow of the first fluid through the capillary first capillary conduit 174, defined in the xz-plane of at least 0.25 $mm^2$.

The primary supply well 131 comprises a bottom part 136 having a primary through hole 176 and a secondary through hole 177. The primary through hole 176 provides fluid communication between the primary supply well 131 and the capillary structure 173.

The primary through hole 176 tapers towards a side-wall of the primary supply well 131.

The secondary through hole 177 provides fluid communication between the primary supply well 131 and the secondary supply conduit 106. The primary through hole 176 and the secondary through hole 177 are provided at least 2 mm apart.

The microfluidic device 100 comprises a base microfluidic piece 101 and a base well structure piece 102.

The base microfluidic piece 101 forms a base part of the microfluidic section and is provided with a first planar surface 137 having a plurality of ramified recesses providing a base part of the fluid conduit network 135.

The base well structure piece 102 forms a base part of the well section. The base well structure piece 102 forms a second planar surface 138 facing the first planar surface 137 of the base microfluidic piece.

The second planar surface 138 forms part of the microfluidic section. The second planar surface provides a capping part of the fluid conduit network 135. Accordingly, the group of wells 171 forms a fixedly connected unit with the corresponding microfluidic unit 170.

The cross-sectional area of the opening between the primary supply well and the capillary structure, which is provided by the primary through hole 176, is at least 0.5 $mm^2$ measured in the xy-plane.

At least a majority of the capillary structure 173 is provided within 2 mm from a bottom part of the microfluidic device, which is provided by a third planar surface 139 of the base microfluidic piece 101.

An embodiment of the method according to the present invention may e.g. comprise use of the microfluidic device schematically illustrated in FIGS. 1-4, wherein the method comprises providing a first fluid to the primary supply well of a first group of wells and subsequently providing a second fluid to the primary supply well of the first group of wells and subsequently providing a pressure difference between the primary supply well of the first group of wells and the collection well of the first group of wells, such that the pressure within the primary supply well of the first group of wells is higher than within the collection well of the first group of wells.

FIG. 5 schematically illustrates a cross-sectional view of a second embodiment of a microfluidic device 500 according to the present invention, the second embodiment being similar to the first embodiment of a microfluidic device 100. The device 500 is provided with the same base microfluidic piece 101 as the device 100. The device 500 differs from the device 100 in that the base well structure piece 502 is slightly different from the base well structure piece 102 of the device 100 in that 502 is void of material in between the wells 531, 534, e.g. similar to the embodiments 1100 and 1400 illustrated in FIGS. 11-13 and 14-16, respectively. The different shadings of the sections when comparing FIGS. 5 and 6 are unintentional.

FIGS. 7 and 8 schematically illustrate a third embodiment of a microfluidic device 700 according to the present invention.

The microfluidic section 781 and the well section 782, respectively, are schematically indicated by the respective and illustrative dashed boxes.

FIGS. 9 and 10 schematically illustrate a fourth embodiment of a microfluidic device 900 according to the present invention.

The capillary structure 974 comprises a plurality of capillary conduits 975 provided in parallel. Each capillary conduit has a longitudinal extension of at least 8 mm. Each capillary conduit defines a cross-sectional area perpendicular to the longitudinal extension. The aggregated cross-sectional area of the plurality of capillary conduits is at least 0.25 $mm^2$.

FIGS. 11-13 schematically illustrate different views of a sixth embodiment of a microfluidic device 1100 according to the present invention.

The base microfluidic piece 1101 and the base well structure piece 1102, respectively, are schematically indicated by the respective and illustrative dashed boxes.

FIGS. 14-16 schematically illustrate different views of a seventh embodiment of a microfluidic device 1400 according to the present invention.

The device 1400 differs from the previous illustrated embodiments in that the microfluidic section of the device 1400 comprises a plurality of microfluidic units 1470 and in that the well section of the device 1400 comprises a plurality of groups of wells 1471. Eight microfluidic units and eight groups of wells are illustrated.

Each microfluidic unit 1470 form a sample line with a corresponding group of wells 1471. Each sample line corresponds to the device 500 of FIGS. 5 and 6.

FIG. 17 schematically illustrates an isometric sectional view of a part of a conduit of a microfluidic device 1700 according to the present invention. The illustrated part of the conduit may be applied to any of the embodiments of a microfluidic device according to the present invention.

One or more parts or all of each fluid conduit network of any embodiment of a device according to the present invention may form an acute trapezoidal cross section as illustrated in FIG. 17, wherein the longer base edge is provided by the capping part. The acute trapezoidal cross section may form an isosceles trapezoidal cross section, wherein the side walls of equal length may have a tapering of at least 5 degrees and/or at most 20 degrees with respect to a normal of either of the parallel base edges.

The parts 1701 and 1702 are shown slightly exploded for illustrative purposes.

FIG. 18 schematically illustrates a first embodiment of a kit 1862 according to the present invention.

The kit 1862 comprises: one or more of the microfluidic device 1800 according to the present invention; and a plurality of fluids 1859, 1860 configured for use with the microfluidic device according to the present invention. The plurality of fluids comprises a sample buffer 1859 and an oil 1860. The kit comprises an enzyme and nucleotides.

FIGS. 19-21 schematically illustrate different views of an eighth embodiment of a microfluidic device 1900 according to the present invention.

The device 1900 differs from the previous illustrated embodiments in that the device 1900 is configured for provision of double emulsion droplets.

The plurality of supply conduits of the fluid conduit network 1935 comprises a tertiary supply conduit 1909.

The tertiary supply conduit 1909 comprises a first tertiary supply conduit 1909*a* and a second tertiary supply conduit 1909*b* configured to exert a pinching action of the third fluid on a stream of the fluid from the transfer conduit 1912 during use.

The microfluidic unit 1970 comprises a collection conduit 1916 and a second fluid junction 1921.

The second fluid junction 1921 provides fluid communication between the tertiary supply conduit 1909, the transfer conduit 1912, and the collection conduit 1916.

The transfer conduit 1912 comprises a first transfer conduit part having a first affinity for water and extending from the first fluid junction 1920.

The collection conduit 1912 comprises a first collection conduit part extending from the second fluid junction 1921 and having a second affinity for water being different from the first affinity for water.

The microfluidic device 1900 comprises one or more supply wells comprising the primary supply well 1931 and a tertiary supply well 1933. The tertiary supply well 1933 is in fluid communication with the tertiary supply conduit 1909.

The collection well 1934 is in fluid communication with the transfer conduit 1912 via the collection conduit 1916 and the second fluid junction 1921.

The following represents a list of at least some of the references of the drawings, wherein the suffix "X" may refer to any one or more of the following digits: 1, 5, 7, 9, 11, 14, 17, 18, and 19. For instance, X00 may refer to any one or more of the following references: 100, 500, 700, 900, 1100, 1400, 1700, 1800, and 1900.

Any relevant part of the above disclosure may be understood in view of the below list of references in combination with the disclosed drawings.

X00. Microfluidic device
X01. Base microfluidic piece
X02. Base well structure piece
X03. Primary supply conduit
X03*a*. Connection conduit
X04. Primary supply inlet and/or area of the capillary structure being in direct communication with the primary through hole
X06. Secondary supply conduit
X06*a*. First secondary supply conduit
X06*b*. Second secondary supply conduit
X07. Secondary supply inlet and/or area of the secondary supply conduit being in direct fluid communication with the secondary through hole
X09. Tertiary supply conduit
X09*a*. First tertiary supply conduit
X09*b*. Second tertiary supply conduit
X10. Tertiary supply inlet and/or area of the tertiary supply conduit being in direct fluid communication with the tertiary supply well
X12. Transfer conduit
X18. Collection outlet
X16. Collection conduit
X20. First fluid junction
X21. Second fluid junction
X28. Side wall of a conduit
X29. Draft angle defined by a side wall of a conduit
X31. Primary supply well
X33. Tertiary supply well
X34. Collection well
X35. Fluid conduit network
X36. Bottom part of a primary supply well
X37. First planar surface
X38. Second planar surface
X39. Third planar surface
X59. Sample buffer
X60. Oil
X62. Kit
X70. Microfluidic unit
X71. Group of wells
X73. Capillary structure
X74. Capillary conduit
X75. Plurality of capillary conduits in parallel
X76. Primary through hole
X77. Secondary through hole
X81. Microfluidic section
X82. Well section

The invention claimed is:

1. A microfluidic device comprising:

a microfluidic section comprising one or more microfluidic units; and a well section comprising one or more groups of wells comprising one group of wells for each microfluidic unit;

the well section and the microfluidic section forming a fixedly connected unit such that each group of wells forms a fixedly connected unit with a respective corresponding microfluidic unit, each microfluidic unit comprising a fluid conduit network comprising:

a plurality of supply conduits comprising a secondary supply conduit and a primary supply conduit comprising a capillary structure having a volume of at least 2 μL, wherein the secondary supply conduit comprises a first secondary supply conduit and a second secondary supply conduit, wherein the first secondary supply conduit and the second secondary supply conduit are configured to exert a pinching action of a second fluid on a stream of a first fluid from the primary supply conduit during use of the microfluidic device;

a transfer conduit; and a first fluid junction providing fluid communication between the primary supply conduit, the first secondary supply conduit, the second secondary supply conduit, and the transfer conduit;

each group of wells comprising a plurality of wells comprising a collection well and one or more supply wells comprising a primary supply well, the collection well being in fluid communication with the transfer conduit of the corresponding microfluidic unit, the primary supply well being in fluid communication with the primary supply conduit and the secondary supply conduit of the corresponding microfluidic unit wherein the primary supply well of each group of wells comprises a bottom part having a primary through hole and a secondary through hole, the primary through hole providing fluid communication between the primary supply well and the capillary structure of the corresponding microfluidic unit, the secondary through hole providing fluid communication between the primary supply well and the secondary supply conduit, wherein the primary through hole and the secondary through hole are provided at least 2 mm apart.

2. The microfluidic device according to claim 1, wherein the capillary structure of each microfluidic unit comprises a first capillary conduit having a width of at least 2 mm, a depth of at least 0.05 mm, a longitudinal extension of at least 8 mm, and a cross-sectional area perpendicular to the longitudinal extension of at least 0.25 $mm^2$.

3. The microfluidic device according to claim 1, wherein the capillary structure of each microfluidic unit comprises a plurality of capillary conduits provided in parallel, each capillary conduit having a longitudinal extension of at least 8 mm and a cross-sectional area perpendicular to the longitudinal extension, wherein the aggregated cross-sectional area of the plurality of capillary conduits being at least 0.25 $mm^2$.

4. The microfluidic device according to claim 1, wherein, for each microfluidic unit, the combined cross-sectional area of any one or more openings between the primary supply well and the capillary structure is at least 0.5 $mm^2$.

5. The microfluidic device according to claim 1, wherein at least a majority of the capillary structure is configured for provision of a volumetric flow rate for water being at least 0.5 μL/s.

6. The microfluidic device according to claim 1, wherein at least a part of the microfluidic section comprising at least a part of each fluid conduit network is provided in a material having a contact angle to water of between 50° and 89°.

7. The microfluidic device according to claim 6, wherein at least a part of the microfluidic section is provided in poly(methyl methacrylate) and at least a part of the well section is provided in poly(methyl methacrylate).

8. The microfluidic device according to claim 1, comprising a base microfluidic piece and a base well structure piece, the base microfluidic piece forming a base part of the microfluidic section and being provided with a first planar surface having a plurality of ramified recesses providing a base part of each fluid conduit network of the microfluidic device, the base well structure piece forming a base part of the well section and forming a second planar surface facing the first planar surface of the base microfluidic piece, the second planar surface forming part of the microfluidic section and providing a capping part of each fluid conduit network of the microfluidic device.

9. The microfluidic device according to claim 1, wherein at least a majority of each capillary structure is provided within 2 mm from a bottom part of the microfluidic device.

10. The microfluidic device according to claim 1, wherein the plurality of supply conduits of each fluid conduit network comprises a tertiary supply conduit, each microfluidic unit comprising a collection conduit and a second fluid junction, the second fluid junction of each microfluidic unit providing fluid communication within the corresponding fluid conduit network between the tertiary supply conduit, the transfer conduit, and the collection conduit, the transfer conduit of each fluid conduit network comprising a first transfer conduit part having a first affinity for water and extending from the corresponding first fluid junction, the collection conduit of each fluid conduit network comprising a first collection conduit part extending from the corresponding second fluid junction and having a second affinity for water being different from the first affinity for water, the one or more supply wells of each group of wells comprising a tertiary supply well being in fluid communication with the tertiary supply conduit of the corresponding microfluidic unit, the collection well being in fluid communication with the transfer conduit of the corresponding microfluidic unit via the collection conduit of the corresponding microfluidic unit.

11. A microfluidic device comprising:

a microfluidic section comprising one or more microfluidic units; and a well section comprising one or more groups of wells comprising one group of wells for each microfluidic unit;

the well section and the microfluidic section forming a fixedly connected unit such that each group of wells forms a fixedly connected unit with a respective corresponding microfluidic unit, each microfluidic unit comprising a fluid conduit network comprising:

a plurality of supply conduits comprising a secondary supply conduit and a primary supply conduit comprising a capillary structure having a volume of at least 2 μL, wherein the secondary supply conduit comprises a first secondary supply conduit and a second secondary supply conduit, wherein the first secondary supply conduit and the second secondary supply conduit are configured to exert a pinching action of a second fluid on a stream of a first fluid from the primary supply conduit during use of the microfluidic device;

a transfer conduit; and a first fluid junction providing fluid communication between the primary supply conduit, the first secondary supply conduit, the second secondary supply conduit, and the transfer conduit;

each group of wells comprising a plurality of wells comprising a collection well and one or more supply wells comprising a primary supply well, the collection well being in fluid communication with the transfer conduit of the corresponding microfluidic unit, the primary supply well being in fluid communication with the primary supply conduit and the secondary supply conduit of the corresponding microfluidic unit, wherein the microfluidic device further comprises a base microfluidic piece and a base well structure piece, the base microfluidic piece forming a base part of the microfluidic section and being provided with a first planar surface having a plurality of ramified recesses providing a base part of each fluid conduit network of the microfluidic device, the base well structure piece forming a base part of the well section and forming a second planar surface facing the first planar surface of the base microfluidic piece, the second planar surface forming part of the microfluidic section and providing a capping part of each fluid conduit network of the microfluidic device.

12. A microfluidic device comprising:

a microfluidic section comprising one or more microfluidic units; and a well section comprising one or more groups of wells comprising one group of wells for each microfluidic unit;

the well section and the microfluidic section forming a fixedly connected unit such that each group of wells forms a fixedly connected unit with a respective corresponding microfluidic unit, each microfluidic unit comprising a fluid conduit network comprising:

a plurality of supply conduits comprising a secondary supply conduit and a primary supply conduit comprising a capillary structure having a volume of at least 2 μL, wherein the secondary supply conduit comprises a first secondary supply conduit and a second secondary supply conduit, wherein the first secondary supply conduit and the second secondary supply conduit are configured to exert a pinching action of a second fluid on a stream of a first fluid from the primary supply conduit during use of the microfluidic device;

a transfer conduit; and a first fluid junction providing fluid communication between the primary supply conduit, the first secondary supply conduit, the second secondary supply conduit, and the transfer conduit;

each group of wells comprising a plurality of wells comprising a collection well and one or more supply wells comprising a primary supply well, the collection well being in fluid communication with the transfer conduit of the corresponding microfluidic unit, the primary supply well being in fluid communication with the primary supply conduit and the secondary supply conduit of the corresponding microfluidic unit, wherein the plurality of supply conduits of each fluid conduit network comprises a tertiary supply conduit, each microfluidic unit comprising a collection conduit and a second fluid junction, the second fluid junction of each microfluidic unit providing fluid communication within the corresponding fluid conduit network between the tertiary supply conduit, the transfer conduit, and the collection conduit, the transfer conduit of each fluid conduit network comprising a first transfer conduit part having a first affinity for water and extending from the corresponding first fluid junction, the collection conduit of each fluid conduit network comprising a first collection conduit part extending from the corresponding second fluid junction and having a second affinity for water being different from the first affinity for water, the one or more supply wells of each group of wells comprising a tertiary supply well being in fluid communication with the tertiary supply conduit of the corresponding microfluidic unit, the collection well being in fluid communication with the transfer conduit of the corresponding microfluidic unit via the collection conduit of the corresponding microfluidic unit.

* * * * *